US012185754B2

(12) United States Patent
Yamada et al.

(10) Patent No.: US 12,185,754 B2
(45) Date of Patent: Jan. 7, 2025

(54) MAIN BODY UNIT OF AEROSOL GENERATION DEVICE, AEROSOL GENERATION DEVICE, AND NON-COMBUSTION SUCTION DEVICE

(71) Applicant: Japan Tobacco Inc., Tokyo (JP)

(72) Inventors: Manabu Yamada, Tokyo (JP); Kentaro Matsuda, Tokyo (JP)

(73) Assignee: JAPAN TOBACCO INC., Tokyo (JP)

( * ) Notice: Subject to any disclaimer, the term of this patent is extended or adjusted under 35 U.S.C. 154(b) by 931 days.

(21) Appl. No.: 17/237,982

(22) Filed: Apr. 22, 2021

(65) Prior Publication Data

US 2021/0235754 A1 Aug. 5, 2021

Related U.S. Application Data

(63) Continuation of application No. PCT/JP2019/000861, filed on Jan. 15, 2019.

(30) Foreign Application Priority Data

Oct. 26, 2018 (CN) ..... 201811255608.3

(51) Int. Cl.
*A24F 40/40* (2020.01)
*A24F 40/10* (2020.01)
(Continued)

(52) U.S. Cl.
CPC ..... *A24F 40/40* (2020.01); *A24F 40/10* (2020.01); *A24F 40/20* (2020.01); *A24F 40/30* (2020.01)

(58) Field of Classification Search
CPC ..... A24F 40/10; A24F 40/20; A24F 40/30; A24F 40/40; A24F 40/50; A24F 40/53
See application file for complete search history.

(56) References Cited

U.S. PATENT DOCUMENTS

2014/0261495 A1* 9/2014 Novak, III ..... A24F 40/50 392/386
2015/0144147 A1* 5/2015 Li ..... F22B 1/284 392/390

(Continued)

FOREIGN PATENT DOCUMENTS

CN 204670389 U 9/2015
JP 2018-33729 A 3/2018

OTHER PUBLICATIONS

Office Action issued in JP Application No. 2019-090842 mailed on Dec. 24, 2019.

(Continued)

*Primary Examiner* — Alex B Efta
(74) *Attorney, Agent, or Firm* — Birch, Stewart, Kolasch & Birch, LLP

(57) ABSTRACT

A main body unit of an aerosol generation device including a power source; an accommodation portion having a cylindrical shape and configured to store an aerosol source; a suction port part formed with a suction port configured to suck an aerosol made from the aerosol source atomized; and a connector connecting the power source, the accommodation portion, and the suction port part in an axial direction extending a central axis of the maim body unit is provided. The connector includes a first rotation connector configured to release a connection between the power source and the accommodation portion by applying a first torque around the central axis, and a second rotation connector configured to release a connection between the accommodation portion and the suction port part by applying a second torque smaller than the first torque around the central axis.

10 Claims, 23 Drawing Sheets

(51) Int. Cl.
*A24F 40/20* (2020.01)
*A24F 40/30* (2020.01)

(56) References Cited

U.S. PATENT DOCUMENTS

| | | | | |
|---|---|---|---|---|
| 2016/0338406 | A1 | 11/2016 | Liu | |
| 2016/0366935 | A1* | 12/2016 | Liu | H05B 1/0244 |
| 2017/0360095 | A1* | 12/2017 | Batista | A61M 15/0091 |
| 2018/0092401 | A1 | 4/2018 | Cai | |

OTHER PUBLICATIONS

Extended European Search Report for corresponding European Application No. 19876330.2, dated Jun. 28, 2022.

* cited by examiner

MAIN BODY UNIT OF AEROSOL GENERATION DEVICE, AEROSOL GENERATION DEVICE, AND NON-COMBUSTION SUCTION DEVICE

CROSS REFERENCE TO RELATED APPLICATIONS

This application is a Continuation of PCT International Application No. PCT/JP2019/000861, filed on Jan. 15, 2019, which claims priority under 35 U.S.C. 119 (a) to patent application No. 201811255608.3, filed in China on Oct. 26, 2018, all of which are hereby expressly incorporated by reference into the present application.

TECHNICAL FIELD

The present invention relates to a main body unit of an aerosol generation device, an aerosol generation device, and a non-combustion suction device.

BACKGROUND ART

Conventionally, a non-combustion suction device (hereinafter simply referred to as a suction device) configured to taste a flavor by aspirating steam (for example, an aerosol) atomized by heating is known. There is a device having an atomization unit in which atomizable content (for example, an aerosol source) is stored and a power unit in which a storage battery is mounted as this kind of suction device. In the suction device, the heater disposed in the atomization unit generates heat by the power supplied from the storage battery. Accordingly, the content in the atomization unit is atomized. A user can suction the atomized aerosol together with the air through a suction port of the atomization unit.

For example, in Chinese Utility Model Patent Publication No. 204670389 shown below, a configuration that an atomization unit is attached to a power unit to be attachable to and detachable from the main body unit by using a rotation connection mechanism is disclosed.

By the way, in order to replace or replenish the aerosol source while attaching the atomization unit to the power unit, the suction port is necessary to be removed from the accommodation portion storing the aerosol source of the atomization unit so as to be detachable and attachable to the accommodation portion by providing the above rotation connection mechanism between the suction port and the accommodation portion. However, when the suction port is removed from the accommodation portion, the atomization unit (the accommodation portion) and the power unit (the power source part) may be rotated with the suction part.

An object of the present invention is to provide a main body unit of an aerosol generation device, an aerosol generation device and a non-combustion suction device for preventing the accommodation portion and the power source from rotating with the suction port when the suction port is removed from the accommodation portion.

SUMMARY (1) A main body unit of an aerosol generation device including a power source; an accommodation portion having a cylindrical shape and configured to store an aerosol source; a suction port part formed with a suction port configured to suck an aerosol made from the aerosol source atomized; and a connector connecting the power source, the accommodation portion, and the suction port part in an axial direction extending a central axis of the maim body unit is provided. The connector includes a first rotation connector configured to release a connection between the power source and the accommodation portion by applying a first torque around the central axis, and a second rotation connector configured to release a connection between the accommodation portion and the suction port part by applying a second torque smaller than the first torque around the central axis.

(2) In the main body unit of an aerosol generation device according to the aspect (1), rotation directions around the central axis of the first rotation connector and the second rotation connector for connecting and disconnecting the connections may be same.

(3) In the main body unit of an aerosol generation device according to the aspect (1), the first rotation connector may connect the power source with the accommodation portion by inserting an engagement protruding portion into an engagement groove and rotating around the central axis. The engagement protruding portion may be provided either of the power source or the accommodation portion, the engagement groove may be provided at the other of the power source or the accommodation portion. The second rotation connector may connect the accommodation portion with the suction port part by screwing a male screw portion with respect to a female screw portion around the central axis of the accommodation portion, the male screw portion may be provided at either of the accommodation portion or the suction port part, the female screw portion may be provided at the other of the accommodation portion or the suction port part.

(4) An aerosol generation device includes the main body unit according to the aspect (1), a cartridge configured to accommodate the aerosol source and inserted into the accommodation portion of the main body unit to be rotatable around the central axis; and a first rotation restriction portion configured to restrict a relative rotation of the cartridge with respect to the accommodation portion.

(5) In the aerosol generation device according to the aspect (4), the first rotation restriction portion may include: a first convex portion provided at either one of the cartridge or the power source and extend toward the other in the axial direction; and a first concave portion provided at the other of the cartridge or the power source and into which the first convex portion is insertable in the axial direction. The first convex portion and the first concave portion may be formed on the same radius with the central axis as a center.

(6) In the aerosol generation device according to the aspect (5) of the present invention, the suction port part may include a cartridge contact portion making the cartridge to rotate with respect to the power source around the central axis.

(7) In the aerosol device according to the aspect (6) of the present invention, the suction port part may include a suction port main body in which the cartridge contact portion is attached, and connected to the accommodation portion via the second rotation connection portion. The cartridge contact portion may contact with the cartridge on the way to connect the suction port main body to the accommodation portion.

(8) The aerosol generation device according to the aspect (7) of the present invention may include a second rotation restriction portion configured to restrict a relative rotation of the cartridge contact portion with respect to the suction port main body.

(9) In the aerosol generation device according to the aspect (8) of the present invention, the second rotation restriction portion may comprise: a second convex portion provided either the suction port main body or the cartridge contact portion and extend toward the other in the axial direction; and a second concave portion provided the other the suction port main body or the cartridge contact portion and into which the second convex portion is insertable in the axial direction. The second concave portion and the suction port may be integrally formed.

(10) In the aerosol generation device according to the aspect (6) of the present invention, a communication hole communicating with the suction port may be formed on a contact surface, to which the cartridge contact portion is contacted, of the cartridge.

(11) In the aerosol generation device according to the aspect (6) of the present invention, the cartridge contact portion may be made of elastic resin.

(12) A non-combustion suction device according to an aspect of the present invention includes the aerosol device according to the aspect (5), and a flavor source container attached to the suction port part of the aerosol generation device.

DETAILED DESCRIPTION OF THE PREFERRED EMBODIMENT

Hereinafter, an embodiment of the present invention will be described with reference to figures.

[Suction Device]

Figure 1:
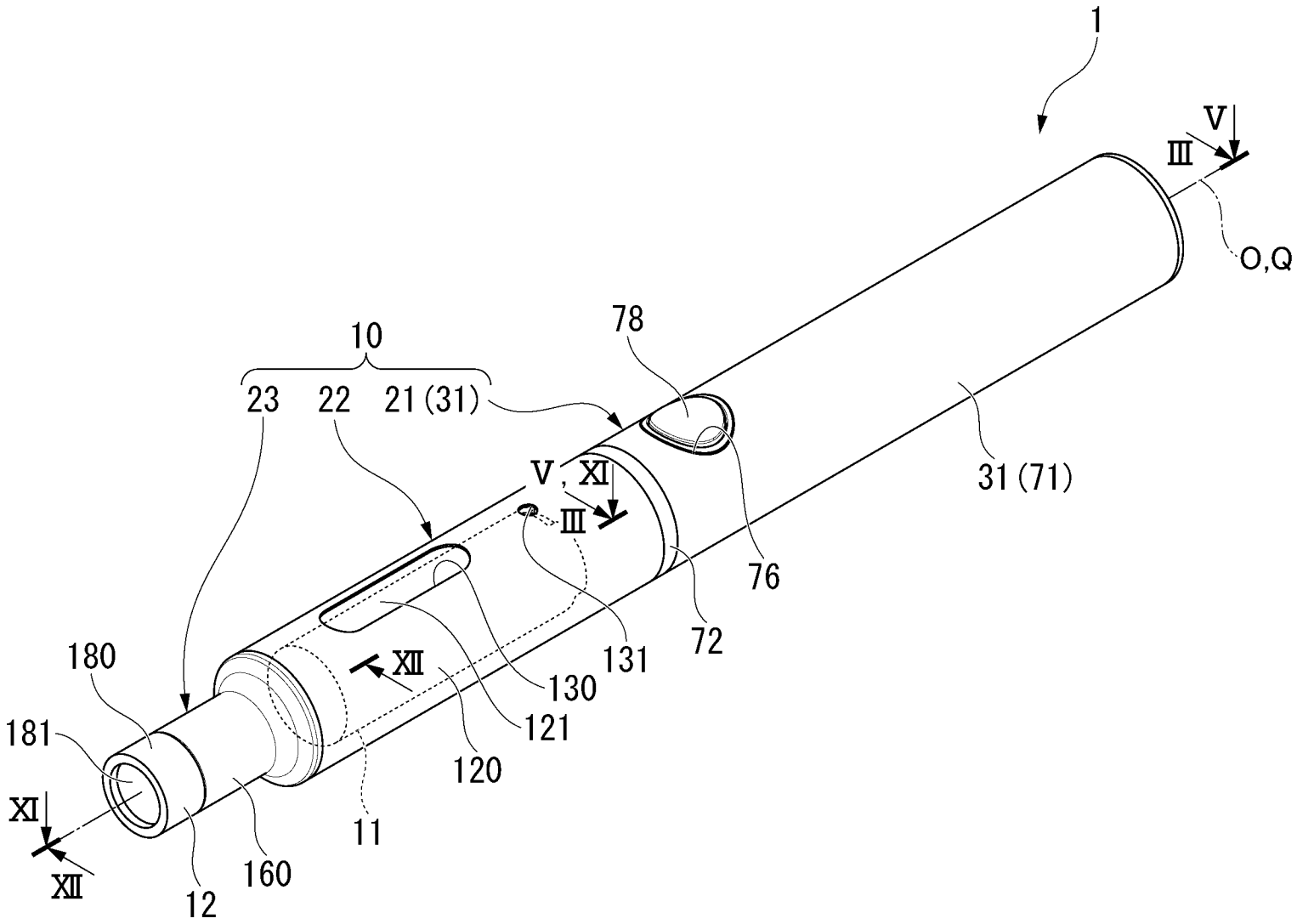
FIG. 1 is a perspective view showing a non-combustion suction device according to an embodiment.

FIG. 1 is a perspective view showing a suction device.

A suction device 1 shown in FIG. 1 is a so-called non-combustion suction device configured for tasting the flavor of tobacco by inhaling aerosol atomized by heating through the tobacco.

The suction device 1 includes a main body unit 10, a tobacco capsule 12, and a cartridge (also referred to as an atomization unit) 11 attached to the main body unit 10 configured to be attachable to and detachable from the main body unit 10.

[Main Body Unit]

Figure 2:
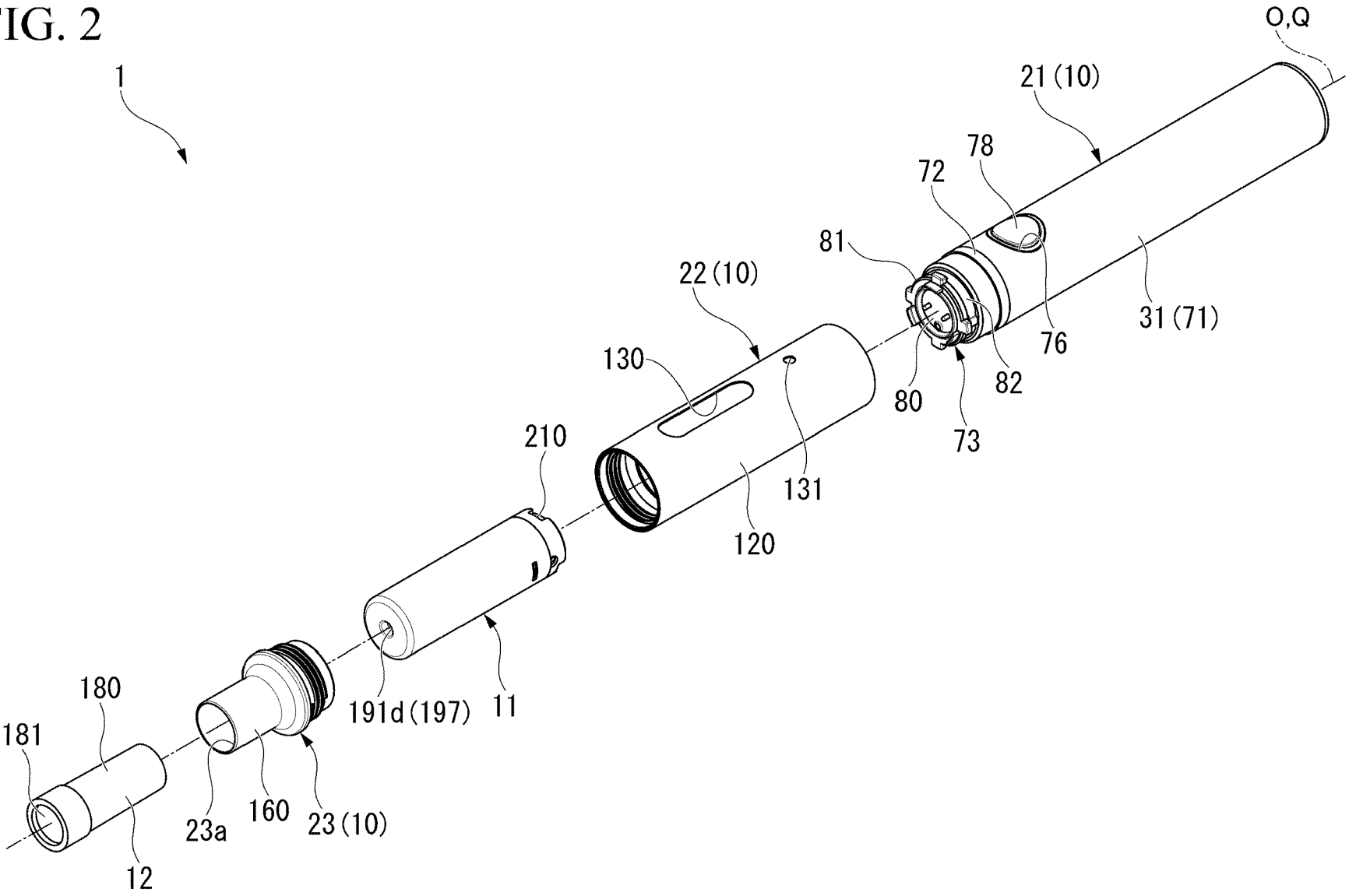
FIG. 2 is an exploded perspective view showing the non-combustion suction device according to the embodiment.

FIG. 2 is an exploded perspective view of the suction device 1.

As shown in FIG. 2, the main body unit 10 includes a power unit 21, a retention unit 22, and a mouthpiece 23. The power unit 21, the retention unit 22, and the mouthpiece 23 are formed in cylindrical shapes with an axis O as a central axis respectively and disposed to be arranged on the axis O. In the following description, the direction along the axis O is described as an axial direction (a normal direction). In this case, in the axial direction, a side from the mouthpiece 23 toward the power unit 21 can be referred to as an opposite-suction-port side or a first end direction side, and a side from the power unit 21 toward the mouthpiece 23 can be referred to as a suction-port side or a second end direction side. A direction intersecting with the axis O in a plan view seen from the axial direction may be referred to as a radial direction, and a direction around the axis O may be referred to as a circumferential direction. In this specification, the recitation "direction" means two directions, and in a case of indicating one of the "directions", the recitation "side" is disclosed.

[Power Unit]

Figure 3:
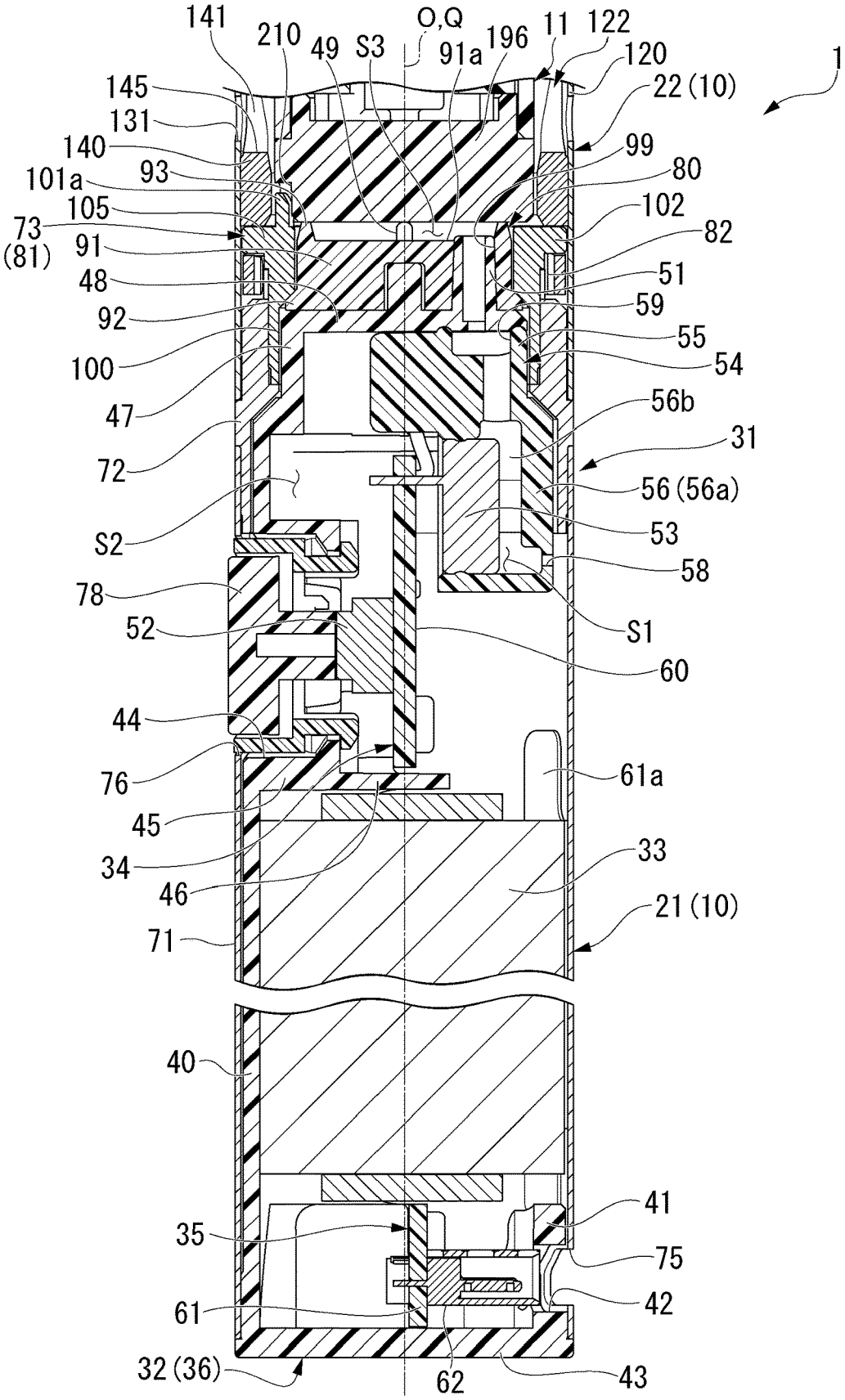
FIG. 3 is a cross-sectional view corresponding to line III-III in FIG. 1.

FIG. 3 is a cross-sectional view corresponding to line III-III in FIG. 1.

As shown in FIG. 3, the power unit 21 includes a housing 31 and a holder assembly 32 accommodated in the housing 31.

[Holder Assembly]

Figure 4:
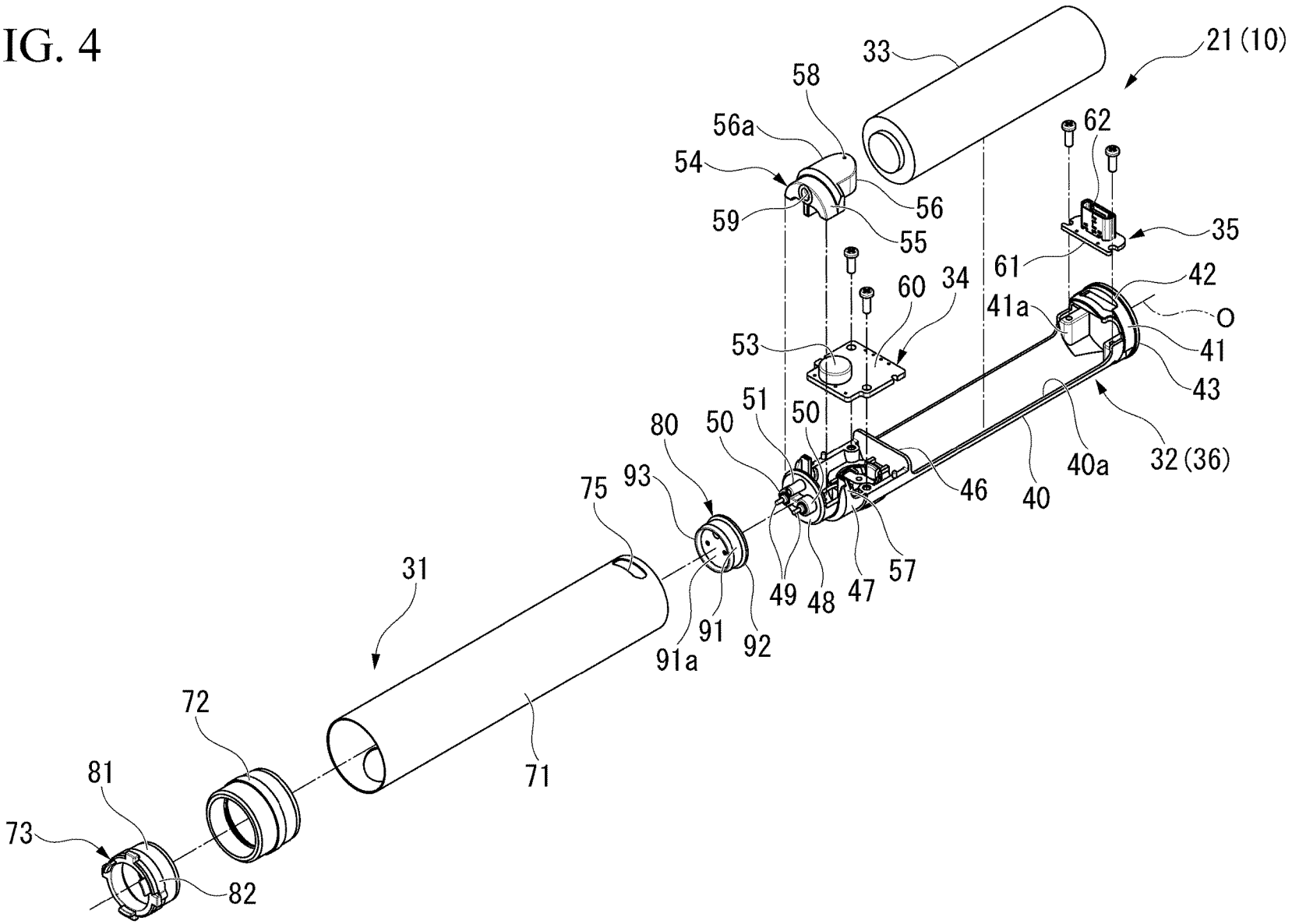
FIG. 4 is an exploded perspective view showing a power unit according to the embodiment.

FIG. 4 is an exploded perspective view showing the power unit 21.

As shown in FIG. 3 and FIG. 4, a holder assembly 32 is configured by mounting a storage battery 33, a substrate module (first substrate module 34 and second substrate module 35) and the like on a storage-battery holder 36.

For example, the storage-battery holder 36 is integrally formed from a resin material. The storage-battery holder 36 has a base portion 40. The base portion 40 is formed in a semi-cylindrical shape with the axis O as a central axis. In the base portion 40, if an assembly opening 40*a* (see FIG. 4) for receiving the storage battery 33 and the like opens outward in the radial direction, the base portion 40 may be formed in a shape besides the semi-cylindrical shape.

In the base portion 40, a press-fit cylindrical portion 41 extends to an end portion at an opposite side with respect to the retention unit 22 in the axial direction. The press-fit cylindrical portion 41 is formed in a cylindrical shape with the axis O as a central axis. In the press-fit cylindrical portion 41, a connector-passage hole 42 penetrating the press-fit cylindrical portion 41 in the radial direction is formed in part of the press-fit cylindrical portion 41 in the circumferential direction. In the press-fit cylindrical portion 41, an opening portion positioned at an opposite side with respect to the retention unit 22 in the axial direction is blocked by a blocking portion 43. The blocking portion 43 is formed in a circular shape having a larger diameter than that of the press-fit cylindrical portion 41.

A button opening 44 (see FIG. 3) is formed in a part of the base portion 40 positioned at the retention unit 22 side in the axial direction. The button opening 44 penetrates part of the base portion 40 in the circumferential direction of the base portion 40 in the radial direction. For example, the above-described connector-passage hole 42 and the button opening 44 are arranged in different positions at 180 degrees in the circumferential direction. According to the present embodiment, the radial direction through each center of the connector-passage hole 42 and the button opening 44 arranged in the circumferential direction is referred to as a front-rear direction. In this case, the connector-passage hole 42 side with respect to the axis O is referred to as a rear side, and the button opening 44 side with respect to the axis O is referred to as a front side. The positions of the connector-passage hole 42 and the button opening 44 may be suitable changed.

In the base portion 40, a button-guide tube 45 extending to the rear side is formed in an opening edge of the button opening 44. The button-guide tube 45 surrounds the circumference of the button opening 44.

In the base portion 40, a partition wall 46 configured to partition the base portion 40 in the axial direction is formed in a portion positioned at the opposite side of the retention unit 22 more than the button opening 44 in the axial direction.

Figure 5:
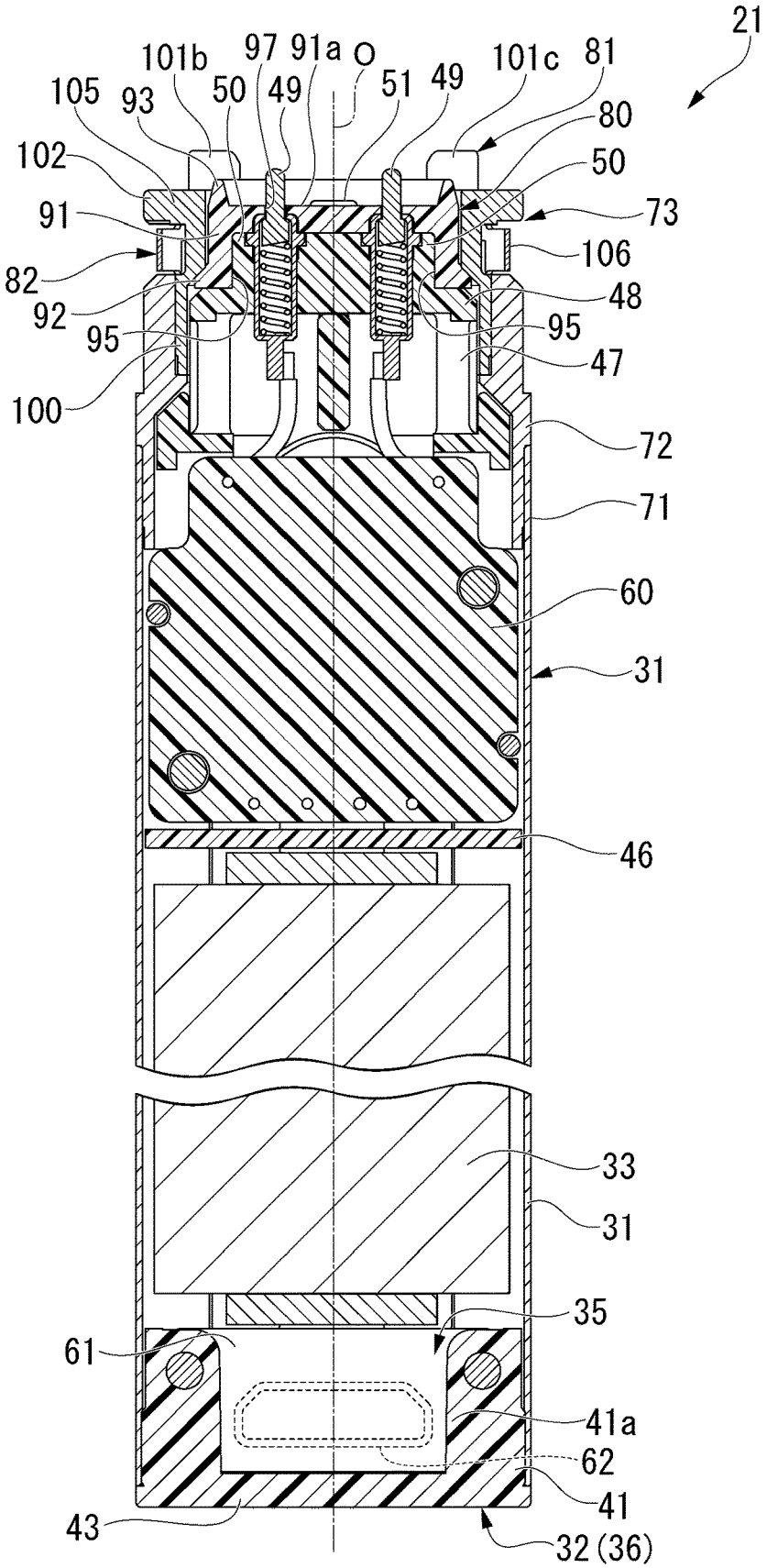
FIG. 5 is a cross-sectional view corresponding to line V-V in FIG. 1.

FIG. 5 is a cross-sectional view corresponding to line V-V in FIG. 1.

As shown in FIG. 3 to FIG. 5, a step portion 47 communicates with an end portion positioned at the retention unit 22 side of the base portion 40 in the axial direction. The step portion 47 is formed in a semi-cylindrical shape to be coaxial with the base portion 40, and a distance from the axis O in the radial direction gradually decreases as approaching the retention unit 22 in the axial direction. A connection pedestal 48 communicates with an end edge positioned at the retention unit 22 side in the axial direction in the step portion 47. The connection pedestal 48 is formed in a circular shape with the axis O as a central axis. A pair of electrode retainers 50 and a communication port 51 are formed in the connection pedestal 48.

As shown in FIG. 4 and FIG. 5, the pair of electrode retainers 50 are formed in tubular shapes protruding toward the retention unit 22 in the axial direction. The pair of the electrode retainers 50 are positioned at two sides of the axis O in the radial direction. According to the present embodiment, the pair of the electrode retainers 50 are arranged in a direction (hereinafter, may be referred to as a left-right direction) orthogonal to the above-described front-rear direction among the radial directions. Each electrode retainer 50 extends in the axial direction and is communicated with each other in the radial direction.

As shown in FIG. 3 and FIG. 4, the communication port 51 protrudes from a portion that is positioned at the rear side in the radial direction with respect to the axis O in the connection pedestal 48 toward the retention unit 22 side in the axial direction.

As shown in FIG. 5, a pin electrode 49 is individually held by each electrode retainer 50. The pin electrode 49 is configured from a pin-shaped electrode main body that is elastically supported in a tubular case. The pin electrode 49 is configured that the electrode main body penetrates the electrode retainer 50 in the axial direction in a state in which the tubular case is fitted into the electrode retainer 50. In two end portions of the pin electrode 49 (electrode main body) in the axial direction, the end portion positioned at the opposite side of the retention unit 22 in the axial direction is connected to a first substrate 60 via electrode wirings in the storage-battery holder 36.

The storage battery 33 is formed in a cylindrical shape with the axis O as the axial direction. The storage battery 33 is accommodated in a portion in the base portion 40 that is positioned at the opposite side of the retention unit 22 in the axial direction with respect to the partition wall 46. A power source included in the suction device 1 as a rechargeable and dischargeable power source is not be limited to a secondary battery such as the storage battery 33 and the like and may be a supercapacitor and the like. The power source may be a primary battery.

As shown in FIG. 3 and FIG. 4, the first substrate module 34 is disposed in a part of the base portion 40 positioned at the retention unit 22 side in the axial direction with respect to the partition wall 46. More specifically, the first substrate module 34 has a first substrate 60, a switching element 52 (see FIG. 3), and a pressure sensor 53.

The first substrate 60 is configured to have the front-rear direction as a thickness direction. More specifically, the first substrate 60 is fixed to the base portion 40 by screws and the like in a state of being placed on an opening end surface of the assembly opening 40*a*. The first substrate 60 is connected to the storage battery 33 via a first connection wiring (not shown). In the example shown in FIG. 3, the first substrate 60 is positioned on the axis O.

The switching element 52 is disposed at a position overlapping the button opening 44 on a front surface (first principal plane) of the first substrate 60 when viewed from the front-rear direction. According to the present embodiment, the switching element 52 is surface mounted on the first substrate 60. The switching element 52 may be mounted on the first substrate 60 in a state in which a connection terminal extending from the switching element 52 is inserted through the penetration hole of the first substrate 60.

The pressure sensor 53 is disposed at the retention unit 22 side with respect to the switching element 52 in the axial direction on a rear surface (second principal plane) of the first substrate 60. In other words, the pressure sensor 53 is disposed at a position that does not overlap the switching element 52 in a planar view in the front-rear direction.

According to the present embodiment, the pressure sensor 53 is disposed at the position shifting to the retention unit 22 side in the axial direction with respect to the switching element 52; however, the configuration is not limited thereto. In other words, if the switching element 52 and the pressure sensor 53 are disposed at misaligned positions in the in-plane direction of the first substrate 60, the switching element 52 and the pressure sensor 53 may be disposed at misaligned positions at the opposite side of the retention unit 22 in the axial direction and may be disposed at misaligned positions in the left-right direction among the radial directions.

The pressure sensor 53 may be configured by adopting an electrostatic capacitance type sensor for example. In other words, the pressure sensor 53 is configured to detect behavior of diaphragm deforming in response to pressure change as the change of electrostatic capacitance. The pressure sensor 53 according to the present embodiment is mounted on the first substrate 60 in the state in which a connection terminal extending from the pressure sensor 53 is inserted through the penetration hole of the first substrate 60. The pressure sensor 53 may be surface mounted on the first substrate 60.

A sensor holder 54 is attached to the pressure sensor 53. The sensor holder 54 is formed from a resin material such as a silicone resin and the like that is softer than the storage-battery holder 36 and has elasticity. The sensor holder 54 has an attachment portion 55 being attached to the storage-battery holder 36 and a cover 56 for covering the pressure sensor 53.

The attachment portion 55 is formed in a semicircular shape. The attachment portion 55 is assembled to the storage-battery holder 36 in a state of being abut by the above-described connection pedestal 48 from the opposite side of the retention unit 22 in the axial direction. A clipping piece 57 (see FIG. 4) is formed in the step portion 47 and configured to retain the attachment portion 55 in the space between the connection pedestal 48 and the step portion 47 in the axial direction. The clipping piece 57 protrudes from two end surfaces of a circular arc in the circumferential direction, wherein the circular arc is positioned at an external side in the radial direction (left-right direction) of the step portion 47.

The cover 56 communicates with the attachment portion 55 at the opposite side of the retention unit 22 in the axial direction. The cover 56 is formed in a cap shape that opens at the front side. A spacer 56*b* swelling toward the front side is formed in a bottom wall portion 56*a* of the cover 56. The pressure sensor 53 is fitted into the cover 56 in a state of being abut by the spacer 56*a*. Accordingly, a gap in the radial direction is formed between the internal surface of the bottom wall portion 56*a* and the pressure sensor 53. An air replacement hole 58 penetrating the bottom wall portion 56*a* in the radial direction is formed in the bottom wall portion 56*a*.

A communication passage 59 communicating the inside of the communication port 51 and the inside of the cover 56 is formed in the above-described attachment portion 55. The communication passage 59 extends along the axial direction in the attachment portion 55. An end portion of the communication passage 59 at the opposite side of the retention unit 22 in the axial direction opens on the internal circumferential surface of the cover 56. On the other hand, an end portion of the communication passage 59 at the retention unit 22 side in the axial direction opens on a surface facing the retention unit 22 side in the axial direction in the attachment portion 55. According to the present embodiment, a minimum inner diameter of the communication passage 59 is larger than a maximum inner diameter of the air replacement hole 58. In the communication passage 59, at least the inner diameter of the end portion at the retention unit 22 side in the axial direction is larger than the inner diameter of the communication port 51.

According to the present embodiment, the communication port 51 and the communication passage 59 are disposed at a position where at least part of the communication port 51 and the communication passage 59 overlaps the pressure sensor 53 when viewed in the axial direction. The communication port 51 and the communication passage 59 may be disposed at a position shifting from the pressure sensor 53 when viewed in the axial direction.

As shown in FIGS. 3-5, the second substrate module 35 is disposed at the opposite side of the first substrate module 34 in the axial direction to sandwich the storage battery 33 therebetween. In other words, the substrate modules 34, 35 according to the present embodiment are disposed at two sides in the axial direction to sandwich the storage battery 33 therebetween. The second substrate module 35 has a second substrate 61 and a female connector 62.

The second substrate 61 is accommodated in the press-fit cylindrical portion 41 having the radial direction (front-rear direction) as the thickness direction. As shown in FIG. 5, the second substrate 61 is fixed to a boss portion 41*a* by screws in a state of being placed on the boss portion 41*a*, wherein the boss portion 41*a* protrudes inwardly from the press-fit cylindrical portion in the radial direction. The second substrate 61 is connected to the first substrate 60 via a second wiring 61*a*. In other words, the second wiring 61*a* is drawn to pass through the circumference of the storage battery 33 in the axial direction at the external side of the storage-battery holder 36.

As shown in FIGS. 3-4, the female connector 62 is used as a configuration for the power charge of the storage battery 33, and a male connector (not shown) drawn from an external power source is inserted into and pulled from the female connector 62. According to the present embodiment, for example, a USB (Universal Serial Bus) connector is adopted as the female connector 62. The female connector 62 is not limited to the USB connector. The female connector 62 is not necessary to be used for the power charge and may be used as a configuration for communication, for example.

The female connector 62 is implemented on the second substrate 61 in a state in which the opening portion faces the rear side. A tip end portion (an end portion close to the opening portion) of the female connector 62 is inserted into the connector-passage hole 42. The female connector 62 may be retracted to the internal side from the connector-passage hole 42 in the radial direction.

(Housing)

As shown in FIGS. 3-4, the housing 31 has an exterior cylindrical portion 71, an intervenient member 72, and a connection mechanism 73.

The exterior cylindrical portion 71 is formed in a cylindrical shape having the axis O as a central axis. The holder assembly 32 is inserted into the exterior cylindrical portion 71 through an opening portion positioned at the opposite side of the retention unit 22 in the axial direction. More specifically, the holder assembly 32 is assembled to the exterior cylindrical portion 71 in a state in which the press-fit cylindrical portion 41 of the storage battery 36 is pressed to fit into an end portion of the exterior cylindrical portion 71 positioned at the opposite side of the retention unit 22. Accordingly, the holder assembly 32 is accommodated into the exterior cylindrical portion 71 in a state in which an end portion positioned at the retention unit 22 side protrudes from the exterior cylindrical portion 71. An opening portion of the exterior cylindrical portion 71 positioned at the opposite side of the retention unit 22 in the axial direction is blocked by the blocking portion 43 of the storage-battery holder 36.

A connector exposure hole 75 is formed in a portion overlapping the connector-passage hole 42 and the female connector 62 viewed in the radial direction in the end portion of the exterior cylindrical portion 71 positioned at the opposite side of the retention unit 22 in the axial direction. The connector exposure hole 75 penetrates the exterior cylindrical portion 71 in the radial direction. According to the present embodiment, a configuration that the female connector 62 opens in the radial direction is described, the female connector 62 may open in the axial direction.

A button exposure hole 76 is formed in a portion overlapping the button opening 44 viewed in the radial direction in the end portion of the exterior cylindrical portion 71 at the retention unit 22 side. The button exposure hole 76 penetrates the exterior cylindrical portion 71 in the radial direction.

The button 78 is accommodated in the button exposure hole 76 and the button opening 44. The button 78 is configured to be movable in the radial direction in a state of being supported by the button-guide tube 45. The button 78 operates to press the switch element 52 while moving inward in the radial direction. A surface of the button 78 is exposed to an external circumferential surface of the exterior cylindrical portion 71 through the button exposure hole 76. The button 78 is not limited to move in the radial direction, for example, the button 78 may be configured to slide in the axial direction. A configuration operating the suction device 1 by a touch sensor or the like instead of the button 78 may be configured.

The intervenient member 72 is formed in a cylindrical shape with the axis O as a central axis. The intervenient member 72 is fitted into an interval between the holder assembly 32 and the exterior cylindrical portion 71 from the retention unit 22 side in the axial direction. Accordingly, a portion between the holder assembly 32 and the exterior cylindrical portion 71 is sealed in the opening portion of the exterior cylindrical portion 71 positioned at the retention unit 22 side in the axial direction.

As shown in FIG. 3, a space surrounded by the sensor holder 54 in the housing 31 configures a pressure change room S1 in which a pressure changes through the communication port 51 in response to the usage (suction) of the suction device 1. On the other hand, in the housing 31, space other than the pressure change room S1 configures a constant pressure room S2 in which the atmospheric pressure applies. According to the present embodiment, among the storage battery 33 and the substrate modules 34, 35, the configurations other than the pressure sensor 53 are accommodated in the constant pressure room S2. If at least the pressure sensor 53 is accommodated in the pressure change room S1, components other than the pressure sensor 53 may be accommodated in the pressure change room S1. In the housing 31, a liquid detection seal and the like may be provided so as to understand infiltration of the liquid.

(Connection Mechanism)

As shown in FIG. 4 and FIG. 5, the connection mechanism 73 has a connection cap 80, a first connection member 81, and an annular piece 82.

The connection cap 80 is formed from a resin material being softer than the storage-battery holder 36 and having elasticity such as the silicone resin and the like. The connection cap 80 is attached to the connection pedestal 48 from the retention unit 22 side in the axial direction. The connection cap 80 has a base portion 91, a flange portion 92, and a surrounding convex portion 93.

As shown in FIG. 5, the base portion 91 is formed in a cylindrical shape having the axis O as a central axis. In the base portion 91, accommodation concave portions 95 recessed toward the retention unit 22 side in the axial direction are formed in positions overlapping each electrode retainer 50 in the planar view respectively. Each accommodation concave portion 95 extends in the axial direction and the accommodation concave portions 95 are communicated in the radial direction. In the base portion 91, an electrode insertion hole 97 is formed at the position overlapping each accommodation concave portion 95 in the planar view. The electrode insertion hole 97 penetrates the base portion 91 in the axial direction and communicates with the inside of the accommodation concave portion 95.

As shown in FIG. 3, in the base portion 91, a port insertion hole 99 is formed at the position overlapping the communication port 51 in the planar view. The port insertion hole 99 penetrates the base portion 91 in the axial direction.

As shown in FIG. 3 and FIG. 5, in the connection cap 80, the electrode retainer 50 is accommodated in each accommodation concave portion 95, and the communication port 51 is inserted into the port insertion hole 99. Accordingly, the connection cap 80 is assembled with the storage-battery holder 36 in a state of abutting with an end surface of the connection pedestal 48 facing the retention unit 22 side in the axial direction. In such state, the pin electrode 49 protrudes toward the retention unit 22 side in the axial direction from the base portion 91 and through the electrode insertion hole 97. The communication port 51 protrudes toward the retention unit 22 side in the axial direction from the base portion 91 and through the port insertion hole 99. In other words, the surface facing the retention unit 22 side in the connection cap 80 (base portion 91) forms a base surface 91*a* from which the pin electrode 49 protrudes and where the communication port 51 opens.

The flange portion 92 expands outwardly in the radial direction in the end portion of the base portion 91 at the opposite side of the retention unit 22 in the axial direction.

The surrounding convex portion 93 protrudes in the axial direction from the end surface of the base portion 91 facing the retention unit 22 side in the axial direction. More specifically, the surrounding convex portion 93 is formed in an annular shape extending along an external circumferential edge of the base portion 91. In other words, the surrounding convex portion 93 is configured to surround the pin electrode 49 and the communication port 51 together at a separated position at the external side in the radial direction with respect to the pin electrode 49 and the communication port 51. If the surrounding convex portion 93 is the configuration to surround the circumference of the pin electrode 49 and the communication port 51 together, the surrounding convex portion 93 may be positioned at an internal side in the radial direction with respect to the external circumferential edge of the base portion 91. The surrounding convex portion 93 is not limited to the annular shape and may be formed in a polygonal shape or the like. According to the present embodiment, the phrase "surrounding" is not limited to a configuration extending continuously and also includes the configuration extending intermittently. In other words, the surrounding convex portion 93 according to the present embodiment may be suitably changed if the surrounding convex portion 93 is the configuration surrounding the circumference of the pin electrode 49 and the communication port 51 together.

The surrounding convex portion 93 is formed in a triangle shape having a sharp tip end toward the retention unit 22 side in the axial direction in a vertical cross-sectional view along the axial direction. A protrusion height of the surrounding convex portion 93 from the base portion 91 is higher than the communication port 51 and lower than the pin electrode 49. The protrusion height of the surrounding convex portion 93 may be higher than the pin electrode 49. The shape of the surrounding convex portion 93 in the vertical cross-sectional view is not limited to the triangle shape.

The first connection member 81 has a base cylindrical portion 100, a vertical engagement convex portion (from first vertical engagement convex portion 101*a* to third vertical engagement convex portion 101*c*), and a horizontal engagement convex portion 102.

The base cylindrical portion 100 is formed in a multi-stage cylindrical shape having the axis O as a central axis, and a dimeter decreases by steps toward the retention unit 22 side in the axial direction. An end portion in the base cylindrical portion 100 positioned at the opposite side of the retention unit 22 in the axial direction is fitted into the internal side of the intervenient member 72. In this state, an end portion in the base cylindrical portion 100 at the retention unit 22 side in the axial direction surrounds the circumference of the connection cap 80 in a state of sandwiching the flange portion 92 in an interval with the connection pedestal 48 in the axial direction. An external flange portion 105 expanding outwardly in the radial direction is formed in the end portion in the base cylindrical portion 100 at the retention unit 22 side in the axial direction.

Figure 6:
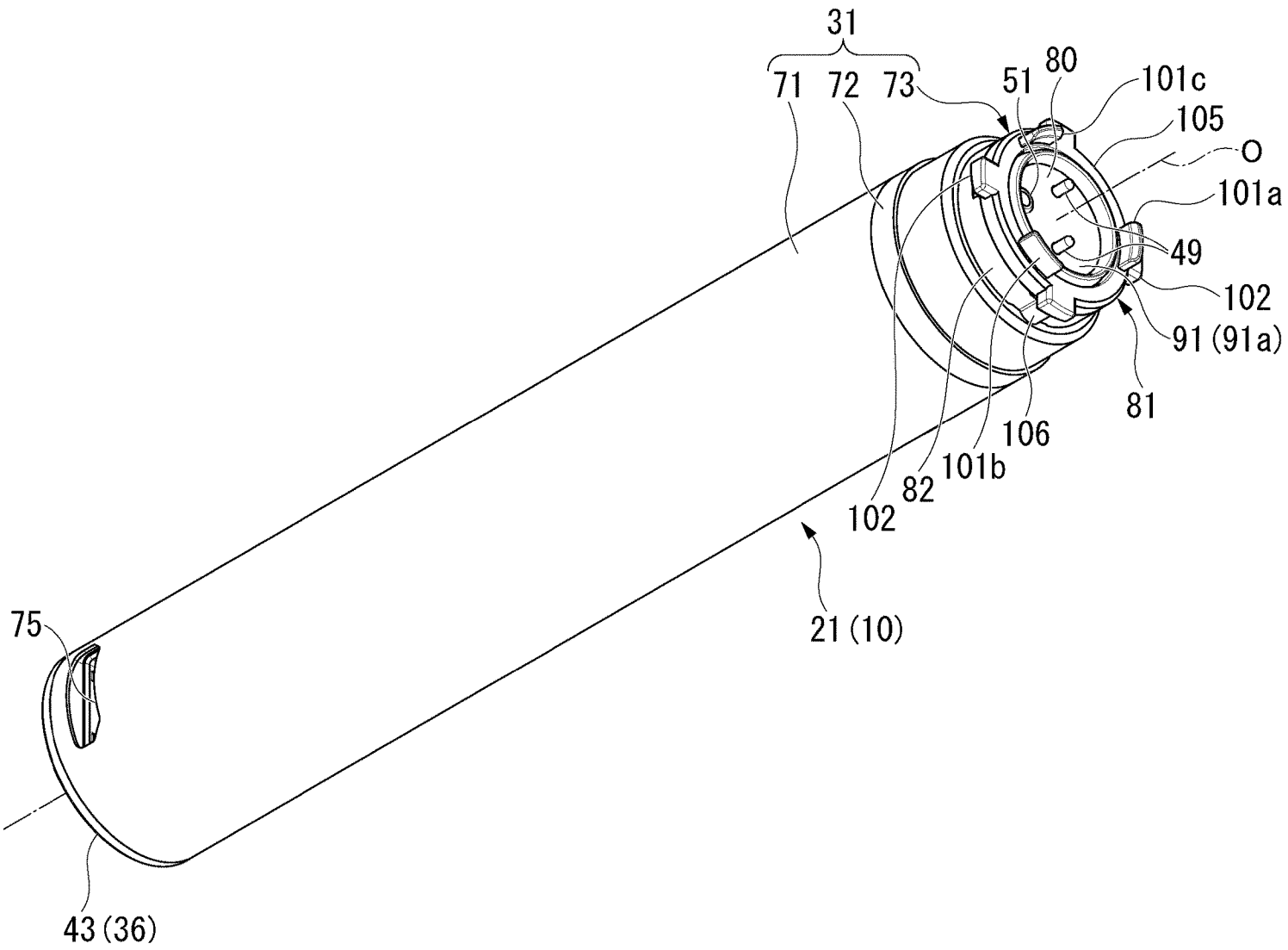
FIG. 6 is a perspective view showing the power unit according to the embodiment.

FIG. 6 is a perspective view of the power unit 21.

As shown in FIG. 5 and FIG. 6, the vertical engagement convex portions 101*a*-101*c* protrude toward the retention unit 22 side in the axial direction from the base cylindrical portion 100. A plurality of the vertical engagement convex portions 101*a*-101*c* are formed to be separated at intervals in the circumferential direction. According to the present embodiment, each of the vertical engagement convex portions 101*a*-101*c* are evenly disposed in the circumferential direction by a 120-degree interval. The vertical engagement convex portions 101*a*-101*c* may be single or multiple. A pitch of the vertical engagement convex portions 101*a*-101*c* may be suitably changed. In this case, the multiple vertical engagement convex portions 101*a*-101*c* may be unevenly disposed.

Figure 7:
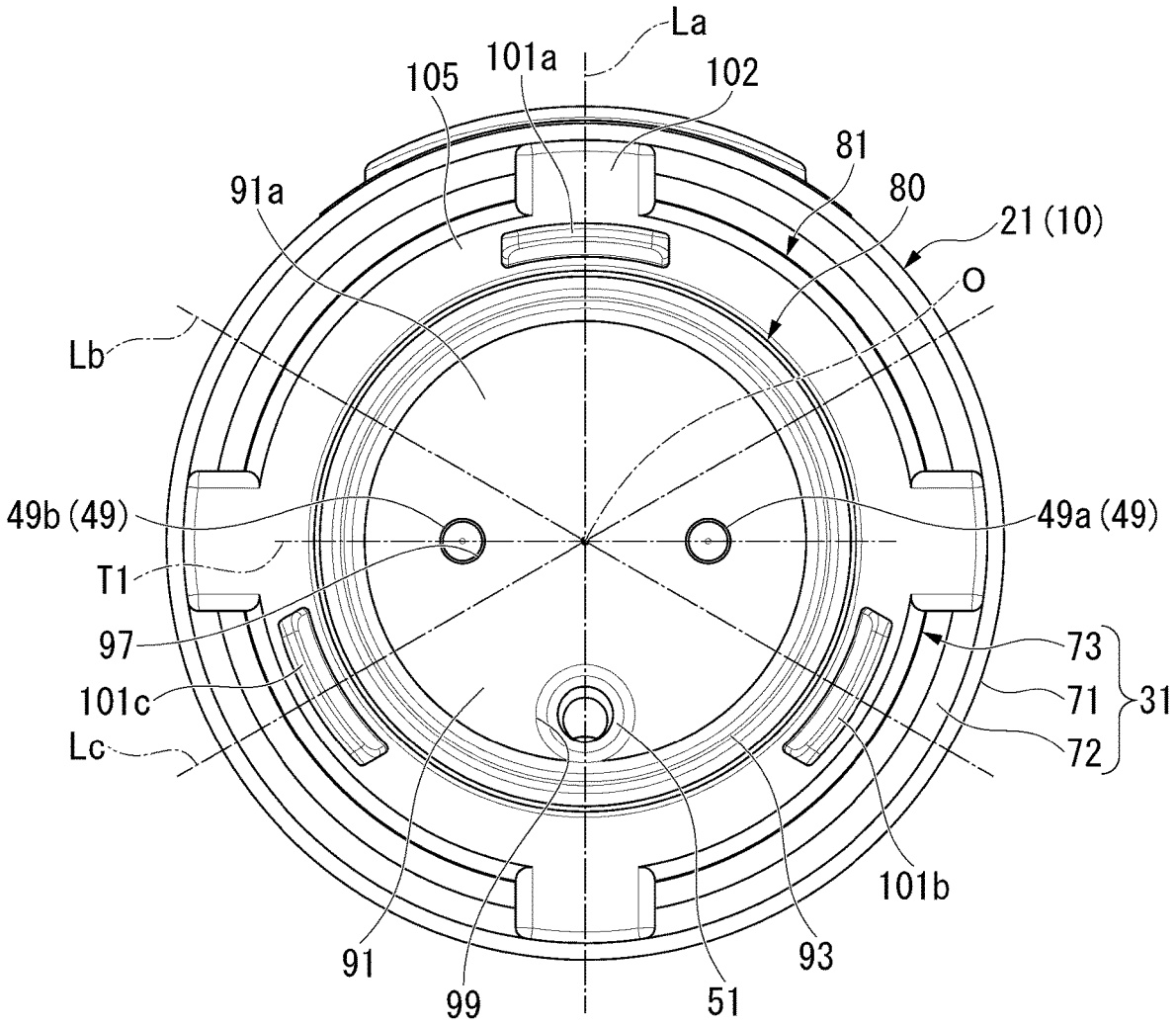
FIG. 7 is a plan view showing the power unit according to the embodiment viewed from a retaining unit side in an axial direction.

FIG. 7 is a planar view showing the power unit 21 viewed from the retention unit 22 side.

As shown in FIG. 7, each of the vertical engagement convex portions 101*a*-101*c* is disposed so as to cause the pin electrode 49 not to be disposed on virtual straight lines La-Lc connecting the center in the circumferential direction of each vertical engagement convex portion 101*a*-101*c* and the axis O. More specifically, the pin electrodes 49 are disposed at positions being line symmetry with respect to the virtual straight line La connecting the first vertical engagement convex portion 101*a* and the axis O. In other words, a virtual straight line T1 connecting each pin electrode 49 is orthogonal to the virtual straight line La and distances from the virtual straight line La to each pin electrode 49 are the same as each other.

As shown in FIG. 5 and FIG. 6, an end edge in each vertical engagement convex portion 101*a*-101*c* positioned at the retention unit 22 side in the axial direction is positioned at the retention unit 22 side in the axial direction more than the pin electrode 49. Each vertical engagement convex portion 101*a*-101*c* is formed in a rectangle shape in a side view from the radial direction respectively. In an end portion at the retention unit 22 side in the axial direction in each vertical engagement convex portion 101*a*-101*c*, a surface facing the internal side in the radial direction is formed as an inclined surface whose thickness in the radial direction gradually becomes thinner toward the retention unit 22 side in the axial direction. The inclined surface functions as a guide for smoothly guiding each vertical engagement convex portion 101*a*-101*c* to an engagement concave portion 210 of the cartridge 11 described below.

The horizontal engagement convex portion 102 protrudes outwardly in the radial direction from the external flange portion 105. The horizontal engagement convex portion 102 is formed in a rectangle shape in the planar view. A plurality of the horizontal engagement convex portions 102 are formed to be separated by intervals in the circumferential direction. According to the present embodiment, each of the horizontal engagement convex portions 102 is evenly disposed in the circumferential direction by a 90-degree interval. According to the present embodiment, a single horizontal engagement convex portion 102 is disposed at the same position with the first vertical engagement convex portion 101*a* in the circumferential direction. The horizontal engagement convex portion 102 may be single or multiple. A pitch of the horizontal engagement convex portions 102 may be suitably changed. In this case, multiple horizontal engagement convex portions 102 may be unevenly disposed.

The annular piece 82 is formed in a thin annular shape. The base cylindrical portion 100 is inserted into the annular piece 82 from the retention unit 22 side in the axial direction such that the annular piece 82 is clipped between the intervenient member 72 and the external flange portion 105 in the axial direction. As shown in FIG. 5, a bending portion 106 is formed in a portion of the annular piece 82 in the circumferential direction. The bending portion 106 is formed in an arch shape expanding outwardly in the radial direction. The bending portion 106 is configured to be elastically deformable in the radial direction. The bending portion 106 is positioned at the internal side in the radial direction more than an external end surface of the horizontal engagement convex portion 102.

A plurality of the bending portions 106 are formed to be separated by intervals in the circumferential direction. For example, the bending portions 106 are disposed at the same positions in the circumferential direction of a pair of horizontal engagement convex portions 102 that are opposed with each other in the radial direction (left-right direction) among the horizontal engagement convex portions 102. A number of the bending portions 106 may be suitably changed. For example, the bending portion 106 may be formed corresponding to each horizontal engagement convex portion 102, or the bending portion 106 may be formed corresponding to only one horizontal engagement convex portion 102.

(Retention Unit)

Figure 8:
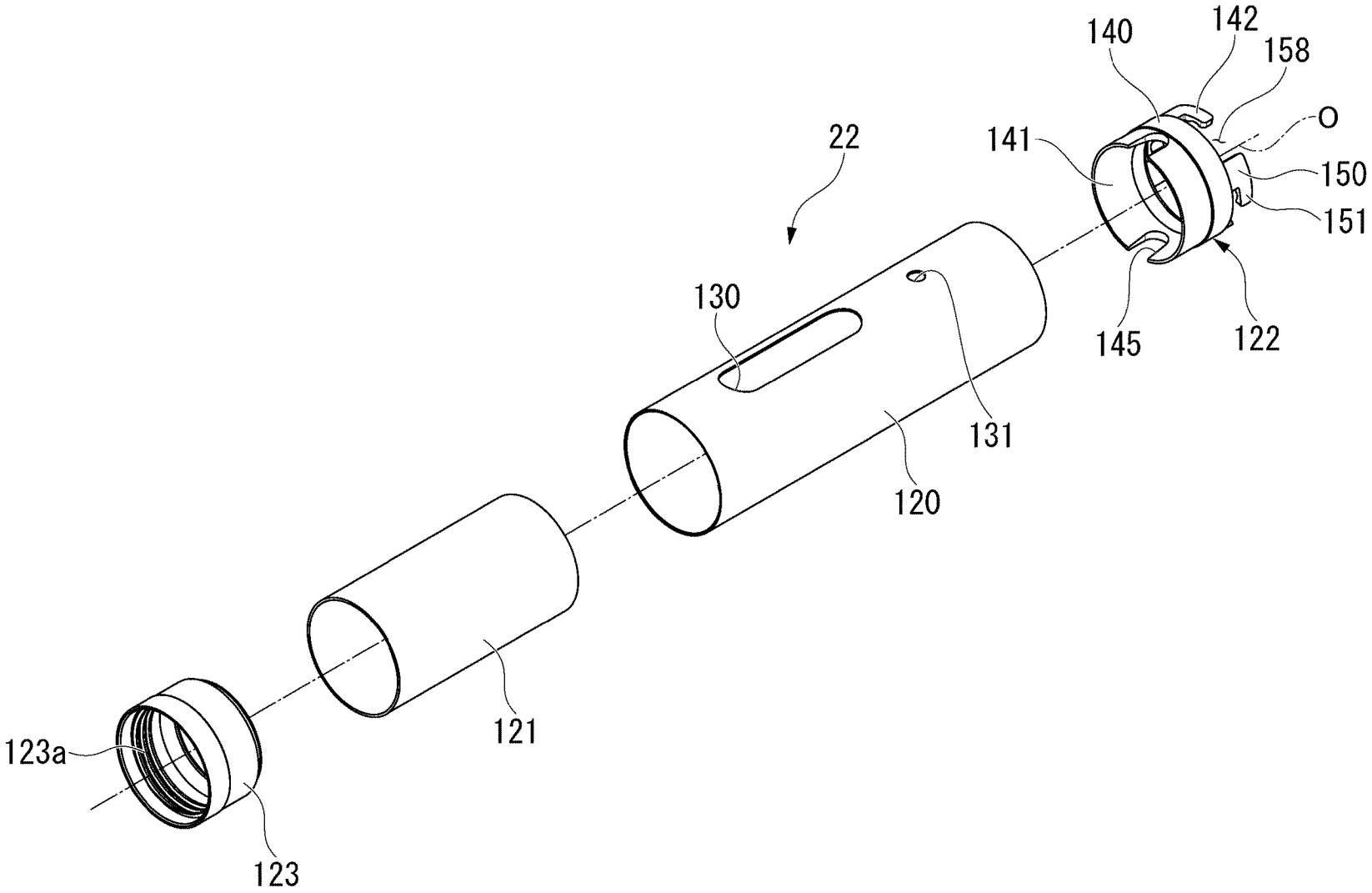
FIG. 8 is an exploded perspective view showing the retaining unit according to the embodiment.

FIG. 8 is an exploded perspective view of the retention unit 22.

As shown in FIG. 8, the retention unit 22 is attached to the main body unit 10 so as to be attachable to and detachable from the main body unit 10. More specifically, the retention unit 22 has a container-retaining cylinder 120, a transmission cylinder 121, a second connection member 122, and a sleeve 123.

The container-retaining cylinder 120 is formed in a cylindrical shape with the axis O as a central axis. An observation hole 130 is formed in a central portion of the container-retaining cylinder 120 in the axial direction. The observation hole 130 penetrates the container-retaining cylinder 120 in the radial direction. The observation hole 130 is formed in an oval shape with the axial direction as a longitudinal direction. The observation hole 130 is formed in a portion of the container-retaining cylinder 120 being opposed with each other in the radial direction. A number, a position, a shape and the like of the observation hole 130 may be suitably changed.

A ventilation hole 131 is formed in a portion of the container-retaining cylinder 120 positioned at the power unit 21 side in the axial direction more than the observation hole 130. The ventilation hole 131 penetrates the container-retaining cylinder 120 in the radial direction. The ventilation hole 131 causes the inside and outside of the retention unit 22 to be communicated with each other. The ventilation hole 131 is formed in a portion of the container-retaining cylinder 120 being opposed with each other in the radial direction (front-rear direction). A number, a position, a shape and the like of the ventilation hole 131 may be suitably changed.

The transmission cylinder 121 is formed from a material having optical transparency. The transmission cylinder 121 is inserted into the container-retaining cylinder 120. More specifically, the transmission cylinder 121 is positioned at the mouthpiece 23 side in the axial direction more than the ventilation hole 131 in the container-retaining cylinder 120 to cover the observation hole 130 from the internal side in the radial direction. In other words, the user can visually recognize the inside of the retention unit 22 through the observation hole 130 and the transmission cylinder 121. The retention unit 22 may be configured without the observation hole 130 and the transmission cylinder 121.

The second connection member 122 is locked by the first connection member 81 at the time of attaching the retention unit 22 to the main body unit 10. More specifically, the second connection member 122 has a fitting cylinder 140, a guide cylinder 141, and a locking piece 142.

The fitting cylinder 140 is formed in a cylindrical shape with the axis O as a central axis. The fitting cylinder 140 is fitted into a portion of the container-retaining cylinder 120 positioned at the power unit 21 side in the axial direction more than the transmission cylinder 121 by press fitting or the like.

The guide cylinder 141 is disposed to be coaxial with the fitting cylinder 140. The guide cylinder 141 extends to the mouthpiece 23 side in the axial direction from the fitting cylinder 140. The guide cylinder 141 is formed in a tapered cylindrical shape whose internal diameter gradually increases toward the mouthpiece 23 side in the axial direction. An external diameter of the guide cylinder 141 is smaller than an external diameter of the fitting cylinder 140. In the guide cylinder 141, a clearance portion 145 is formed at a position overlapping the ventilation hole 131 in a side view viewed from the radial direction. For example, the clearance portion 145 is formed in a U shape having an opening at the mouthpiece 23 side in the axial direction. The ventilation hole 131 opens to the inside of the retention unit 22 through the clearance portion 145. The shape of the clearance portion 145 only has to be configured to cause at least part of the ventilation hole 131 to be exposed in the retention unit 22. In a case in which the guide cylinder 141 and the ventilation hole 131 are disposed in different positions in the axial direction, the guide cylinder 141 may be configured without the clearance portion 145.

Figure 9:
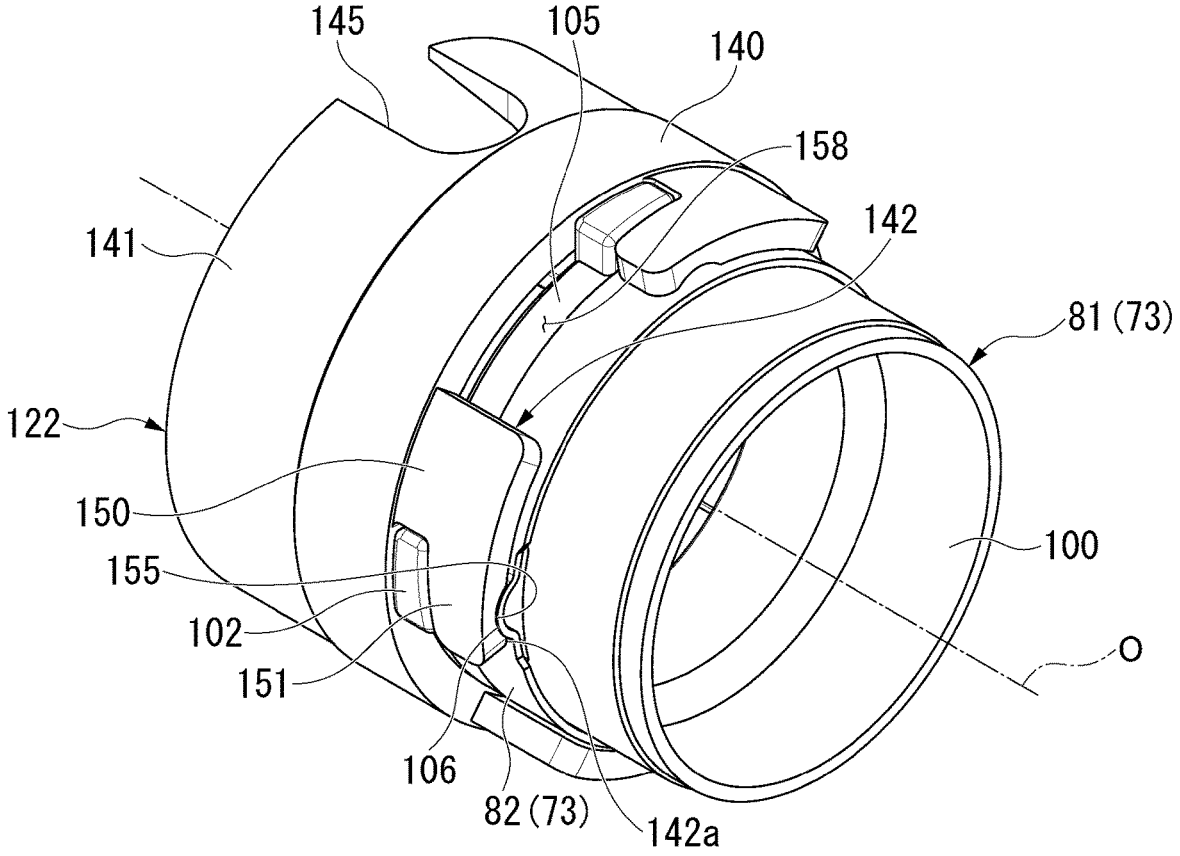
FIG. 9 is a perspective view showing a connection structure of a first connection member and a second connection member according to the embodiment.

FIG. 9 is a perspective view showing a connection structure of the first connection member 81 and the second connection member 122.

As shown in FIG. 8 and FIG. 9, the locking piece 142 protrudes toward the power unit 21 side in the axial direction from the fitting cylinder 140. The locking piece 142 is formed in an L shape in a side view viewed from the radial direction. More specifically, the locking piece 142 has a vertical extending portion 150 and a horizontal extending portion 151.

The vertical extending portion 150 protrudes toward the power unit 21 side in the axial direction from the fitting cylinder 140.

As shown in FIG. 9, the horizontal extending portion 151 extends from an end portion of the vertical extending portion 150 at the power unit 21 side toward one side only in the circumferential direction.

Figure 10:
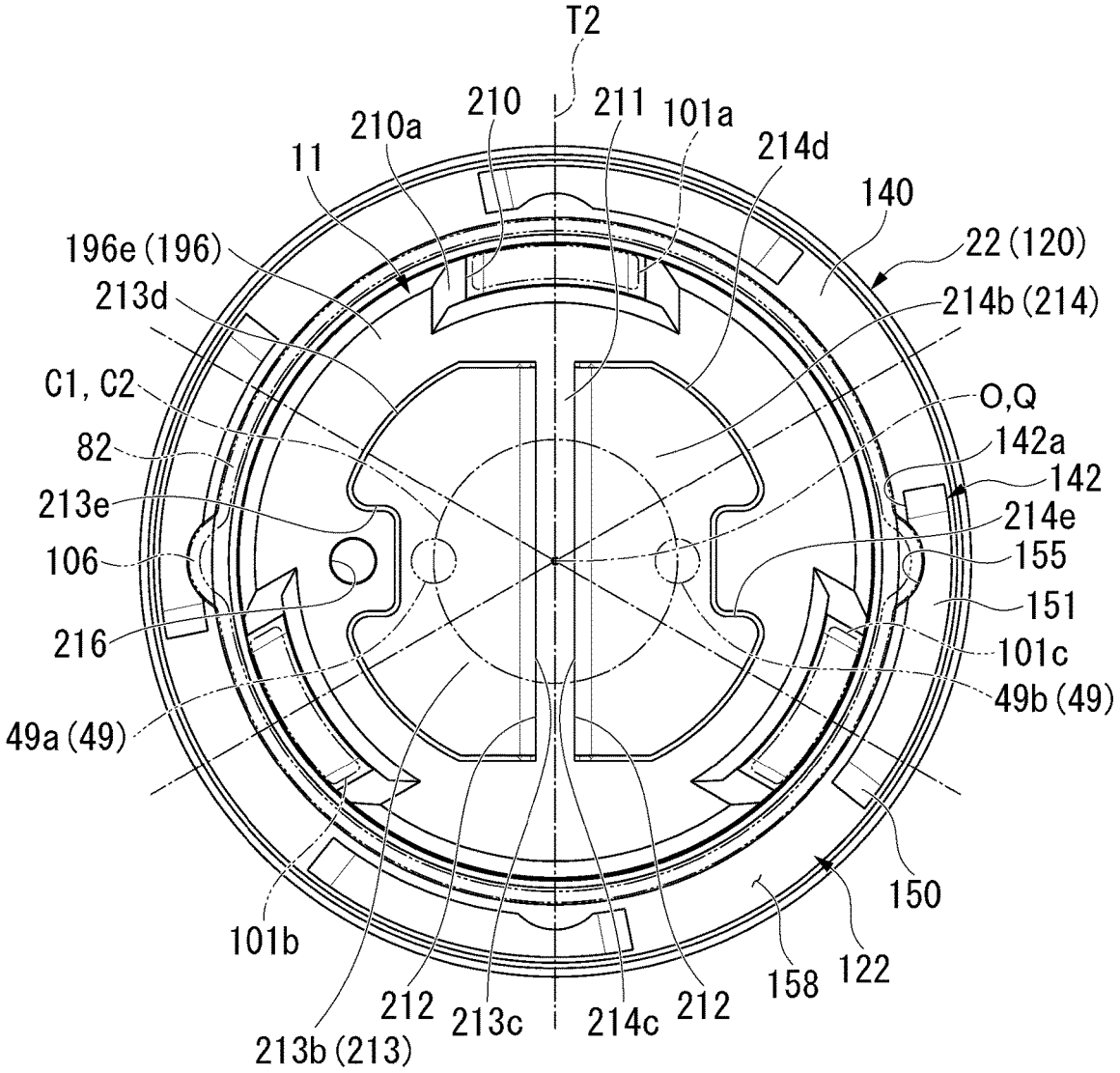
FIG. 10 is a plan view showing the retaining unit and a cartridge according to the present embodiment viewed from the power unit side in the axial direction.

FIG. 10 is a planar view of the retention unit 22 and the cartridge 11 viewed from the power unit 21 side in the axial direction.

As shown in FIG. 9 and FIG. 10, in the horizontal extending portion 151, an engagement concave portion 155 recessed toward the external side in the radial direction is formed in the end portion at the one side of the circumferential direction. The engagement concave portion 155 is formed in a semicircular shape toward the external side in the radial direction.

A plurality of the locking pieces 142 are formed to be separated by intervals in the circumferential direction. According to the present embodiment, each of the locking pieces 142 is evenly disposed in the circumferential direction by a 90-degree interval. Between two adjacent locking pieces 142 in the circumferential direction, an engagement groove 158 is formed for the horizontal engagement convex portion 102 to be inserted. The engagement groove 158 is formed in an L shape in the side view.

As shown in FIG. 2 and FIG. 9, the power unit 21 and the retention unit 22 are configured to be attachable and detachable by connecting the locking piece 142 and the horizontal engagement convex portion 102. In other words, in order to connect the power unit 21 and the retention unit 22, the horizontal engagement concave portion 102 is inserted into the engagement groove 158 in the axial direction, and then the power unit 21 and the retention unit 22 are relatively rotated around the axis O. Accordingly, the horizontal engagement concave portion 102 is engaged between the horizontal extending portion 151 and the fitting cylinder 140 in the axial direction. During the procedure when the power unit 21 and the retention unit 22 are relatively rotated around the axis O, the bending portion 106 of the annular piece 82 are fitted into the engagement concave portion 155. Accordingly, the bending portion 106 is engaged with the engagement concave portion 155 in the circumferential direction. As a result, the power unit 21 and the retention unit 22 are assembled with each other in a state in which position alignment in the axial direction and the circumferential direction is finished.

As shown in FIG. 9, in the engagement groove 158 according to the present embodiment, a portion between the fitting cylinder 140 and the horizontal extending portion 151 is formed in a tapered shape with a width in the axial direction that gradually becomes narrower from the other side toward the one side in the circumferential direction. More specifically, an end surface of the horizontal extending portion 151 facing the mouthpiece 23 side in the axial direction is formed in an inclined surface extending toward the power unit 21 side in the axial direction from the other side toward the one side in the circumferential direction.

The horizontal engagement convex portion 102 is formed in a tapered shape with a width in the axial direction that gradually becomes narrower from the other side toward the one side in the circumferential direction. More specifically, an end surface of the horizontal engagement convex portion 102 facing the opposite side of the retention unit 22 in the axial direction is formed in an inclined surface extending to the mouthpiece 23 side in the axial direction from the one side toward the other side in the circumferential direction. Accordingly, it is possible to prevent interference of the horizontal extending portion 151 and the horizontal engagement convex portion 102 and improve the assembling workability at the time of connecting the power unit 21 with the retention unit 22.

As shown in FIG. 8, the sleeve 123 is fitted into part of the container-retaining cylinder 120 that is positioned at the mouthpiece 23 side more than the transmission cylinder 121 in the axial direction by being pressed or the like. The transmission cylinder 121 is held in the axial direction between the second connection member 122 and the sleeve 123. A female screw portion 123*a* is formed on an internal circumferential surface of the sleeve 123.

(Mouthpiece)

Figure 11:
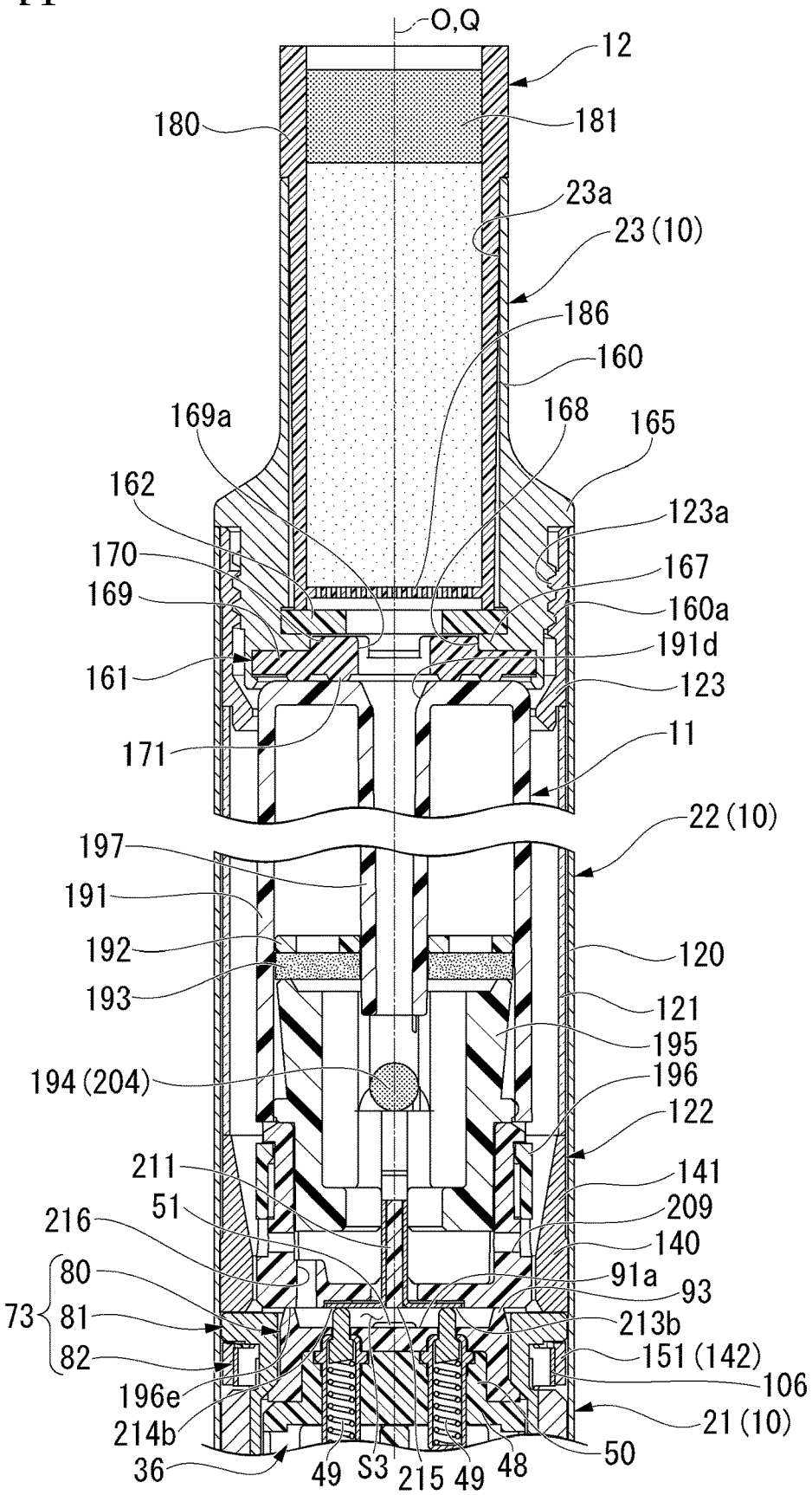
FIG. 11 is a cross-sectional view corresponding to line XI-XI in FIG. 1.
Figure 12:
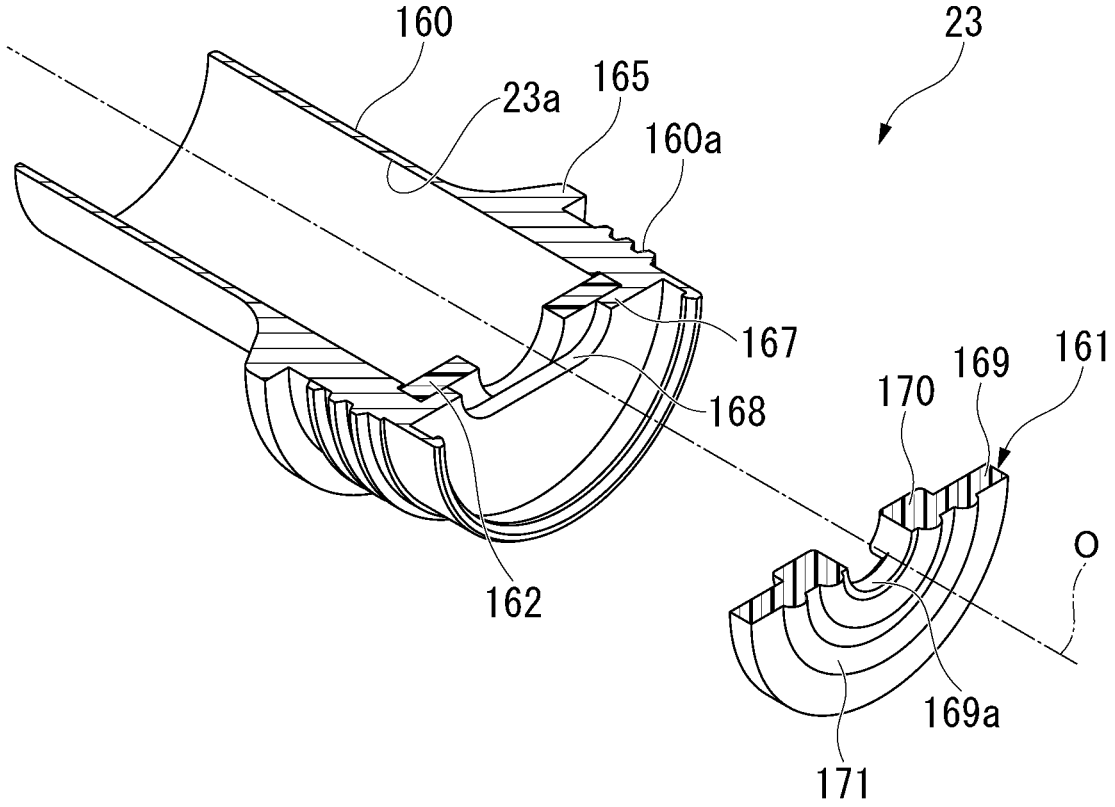
FIG. 12 is an exploded perspective view showing a mouthpiece corresponding to line XII-XII in FIG. 1.

FIG. 11 is a cross-sectional view along line XI-XI in FIG. 1. FIG. 12 is an exploded perspective view of the mouthpiece 23 corresponding to line XII-XII in FIG. 1.

As shown in FIG. 11 and FIG. 12, the mouthpiece 23 has a mouthpiece main body 160 and a slip prevention member (first slip prevention member 161 and second slip prevention member 162).

A suction port 23*a* being capable of accommodating the tobacco capsule 12 is formed in the mouthpiece 23. The mouthpiece main body 160 is formed in a multi-stage cylindrical shape with the axis O as a central axis. A male screw portion 160*a* is formed in an end portion of the mouthpiece main body 160 at the retention unit 22 side in the axial direction. The male screw portion 160*a* of the mouthpiece main body 160 is screwed to the female screw portion 123*a* of the sleeve 123 to be attachable thereto and detachable therefrom. The mouthpiece main body 160 may be a configuration attaching to or detaching from the sleeve 123 by a method besides the screwing (for example, fitting or the like).

In the mouthpiece main body 160, an abutting flange 165 is formed in a portion positioned at the opposite side of the retention unit 22 in the axial direction with respect to the male screw portion 160*a*. The abutting flange 165 is formed in an annular shape extending outwardly in the radial direction. The abutting flange abuts on the retention unit 22 in the axial direction in a state in which the mouthpiece 23 is attached to the retention unit 22. The abutting flange 165 is configured such that an external diameter of the abutting flange 165 gradually decreases away from the retention unit 22 in the axial direction.

A partitioning portion 167 configured to partition the inside of the mouthpiece main body 160 in the axial direction is formed in an end portion of the mouthpiece main body 160 at the retention unit 22 side in the axial direction. In the partitioning portion 167, a penetration hole 168 penetrating the partitioning portion 167 is formed at a position overlapping the axis O. For example, the penetration hole 168 is formed in an oval shape having one direction of the radial direction as a longitudinal direction. A shape of the penetration hole 168 in a planar view may be a perfect circle shape, a polygonal shape or the like.

For example, the first slip prevention member 161 is integrally formed from a resin material such as a silicone resin or the like. The first slip prevention member 161 has a ring portion 169, a fitting protrusion 170, and an engagement protrusion 171.

The ring portion 169 is fitted in the mouthpiece main body 160 from the retention unit 22 side in the axial direction. Position alignment of the first slip prevention member 161 in the axial direction with respect to the mouthpiece main body 160 is performed by the ring portion 169 abutting the partitioning portion 167 in the axial direction.

A communication hole 169*a* is formed in a center of the ring portion 169. The communication hole 169*a* is formed to cause the inside of the retention unit 22 and the inside of the mouthpiece main body 160 to be communicated via the penetration hole 168.

A pair of the fitting protrusions 170 are formed at positions facing each other in the radial direction and sandwiching the communication hole 169*a* therebetween in the internal circumferential edge of the ring portion 169. The fitting protrusions 170 protrude toward the opposite side of the retention unit 22 in the axial direction from the ring portion 169. Each of the fitting protrusions 170 is fitted to two end portions of the penetration hole 168 in the radial direction. Accordingly, position alignment of the first slip prevention member 161 with the mouthpiece main body 160 in the circumferential direction is performed. Accordingly to the present embodiment, the configuration that the fitting protrusions 170 are fitted into the penetration hole 168 is described; however, a configuration that the fitting protrusions 170 are fitted into other hole besides the penetration hole 168 may be configured.

The engagement protrusion 171 protrudes toward the retention unit 22 side in the axial direction from the ring portion 169. The engagement protrusion 171 is formed in a circular shape having the axis O as a center. According to the present embodiment, two of the engagement protrusions 171 are formed in a concentric circular shape. The first slip prevention member 161 may be a configuration without the engagement protrusion 171.

For example, the second slip prevention member 162 is integrally formed from the resin material such as the silicone resin or the like. The second slip prevention member 162 is fitted into the mouthpiece main body 160 from the opposite side of the retention unit 22 in the axial direction. The position alignment of the second slip prevention member 162 with respect to the mouthpiece main body 160 in the axial direction is performed by being abutted by the partitioning portion 167 in the axial direction.

(Tobacco Capsule)

As shown in FIG. 2 and FIG. 11, the tobacco capsule 12 is attached into the mouthpiece main body 160 from the opposite side of the retention unit 22 in the axial direction so as to be attachable thereto and detachable therefrom. The tobacco capsule 12 has a capsule portion 180 and a filter portion 181.

As shown in FIG. 11, the capsule portion 180 is formed in a bottomed cylindrical shape having the axis O as a central axis. In the capsule portion 180, in a bottom wall portion 186 for blocking an opening portion at the retention unit 22 side in the axial direction, a mesh opening penetrating the bottom wall portion 186 in the axial direction is formed.

The filter portion 181 is fitted into the capsule portion 180 from the opposite side of the retention unit 22 in the axial direction. Tobacco are sealed in a space formed by the capsule portion 180 and the filter portion 181.

(Cartridge)

As shown in FIG. 2, the cartridge 11 is configured to store the liquid aerosol source while atomizing the liquid aerosol source. The cartridge 11 is accommodated in the transmission cylinder 121 of the retention unit 22.

Figure 13:
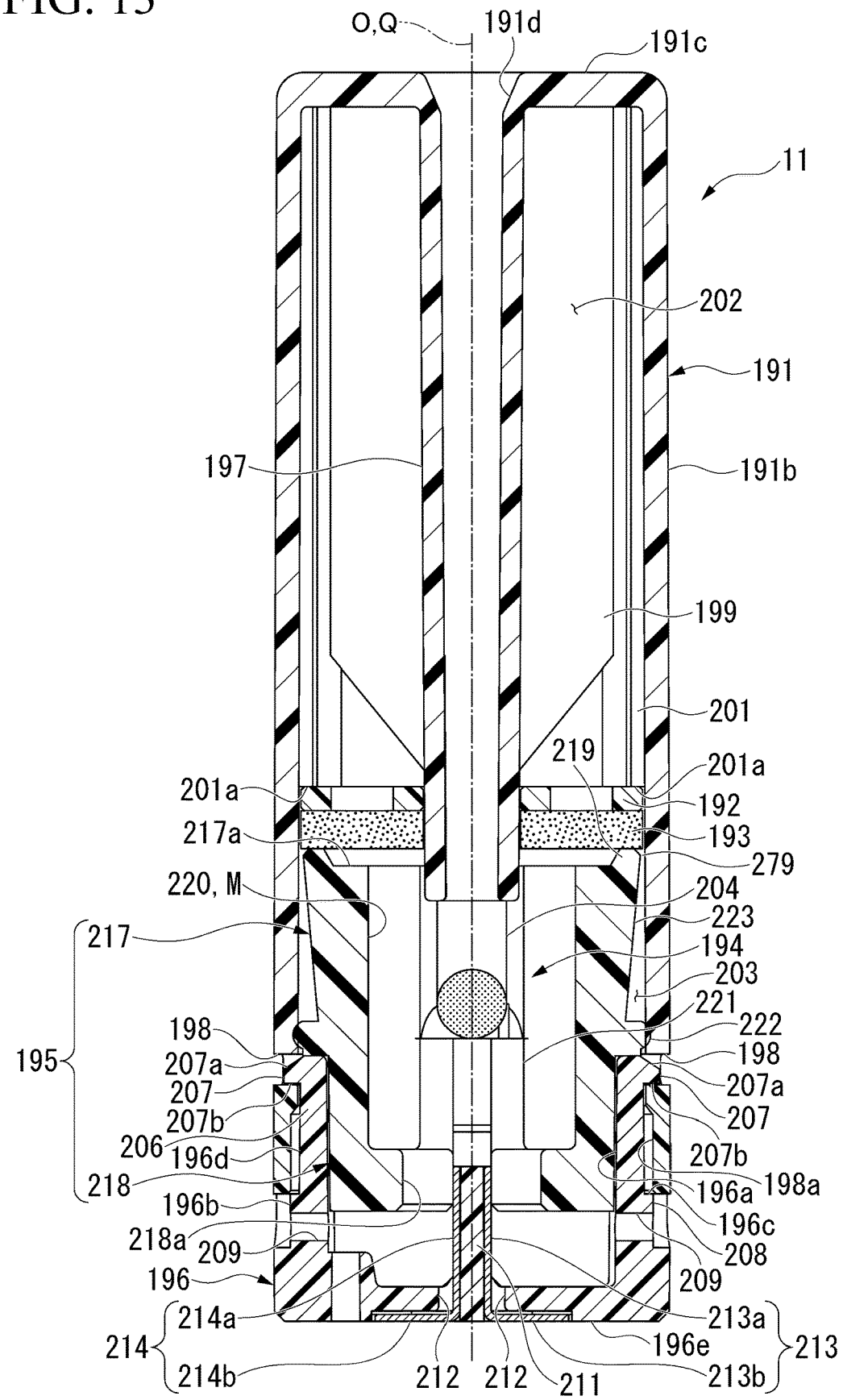
FIG. 13 is a cross-sectional view showing the cartridge according to the present embodiment along the axial direction.
Figure 14:
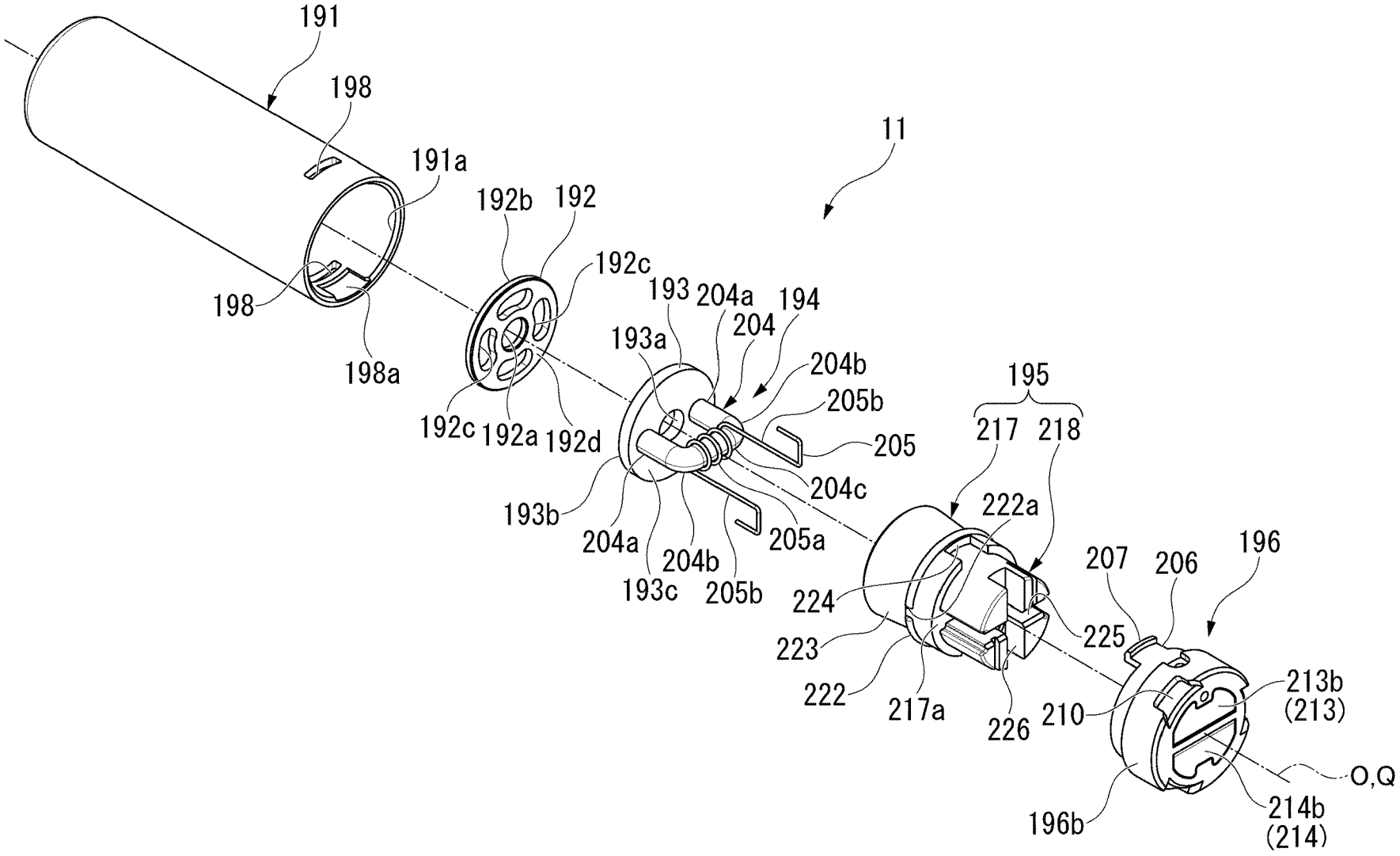
FIG. 14 is an exploded perspective view showing the cartridge according to the present embodiment.

FIG. 13 is a cross-sectional view of the cartridge 11 along the axial direction. FIG. 14 is an exploded perspective view of the cartridge 11.

As shown in FIG. 13 and FIG. 14, the cartridge 11 has a tank 191 formed in a bottomed cylindrical shape, a gasket (also referred to as a support member) 192 formed in a substantially disc shape and accommodated in the tank 191, a mesh body (also referred to as a partition plate) 193 formed in a substantially disc shape, a heater 194, an atomization container (also referred to as a container) 195, and a heater holder 196 configured to block an opening portion 191*a* of the tank 191.

Figure 15:
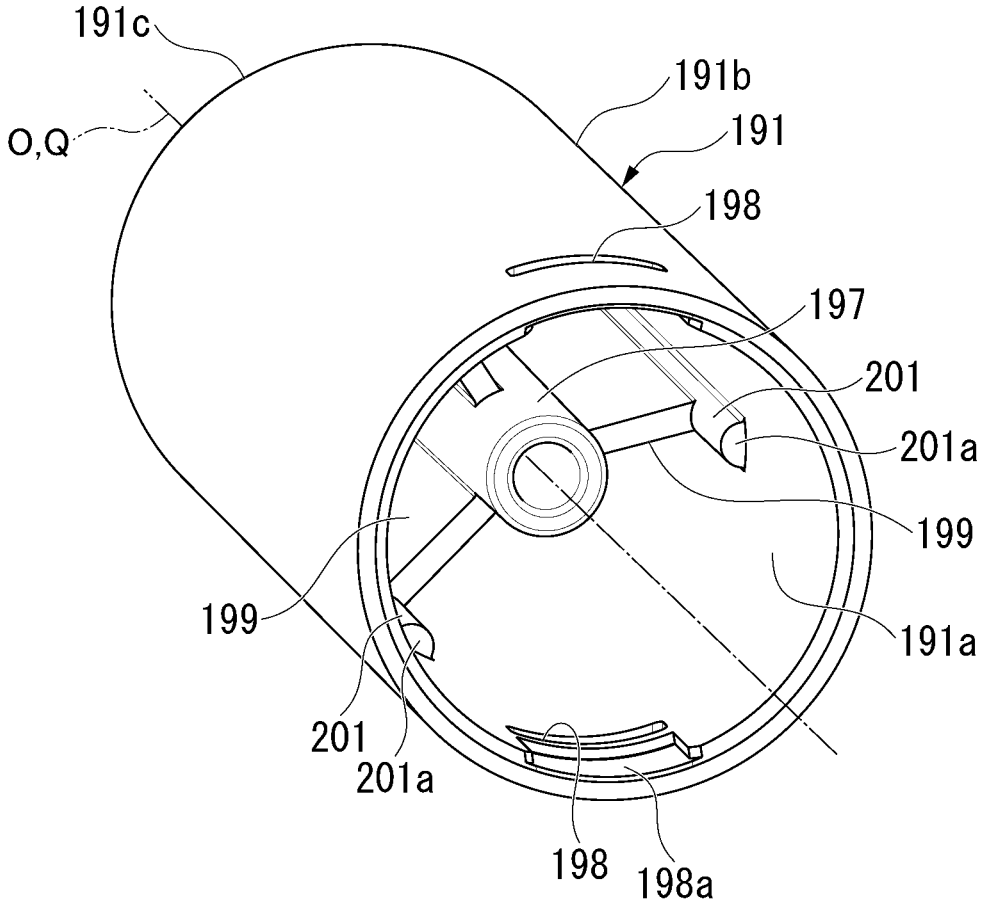
FIG. 15 is a perspective view showing the tank according to the present embodiment viewed from the opening portion side.

FIG. 15 is a perspective view of the tank 191 viewed from the opening portion 191*a* side.

As shown in FIG. 13 to FIG. 15, two engagement holes 198 are formed at a slightly bottom portion 191*c* side more than the opening portion 191*a* in a circumferential wall 191*b* of the tank 191. The engagement hole 198 is configured for fixing the heater holder 196 to the tank 191. The engagement hole 198 is formed in a rectangle shape viewed from the radial direction to become long in the circumferential direction. The two engagement holes 198 are disposed to be opposite to each other and to sandwich an axis Q of the tank 191 at two side of the axis Q. The axis Q coincides with the axis O of the main body unit 10 in a state in which the cartridge 11 is accommodated in the transmission cylinder 121. The axis Q is the common axis of each portion configuring the cartridge 11. Hereinafter, the axis Q is not only described as the axis Q of the tank 191, but also used in the description of each portion configuring the cartridge 11.

A guide concave portion 198*a* is formed on an internal circumferential surface slightly close to the opening portion 191*a* from the engagement hole 198 in the circumferential wall 191*b* of the tank 191. The guide concave portion 198*a* also opens at the opening portion 191*a* side. The guide concave portion 198*a* functions to guide an engagement piece 206 described below when fixing the heater holder 196 to the tank 191.

In the bottom portion 191*c* of the tank 191, a penetration hole 191*d* penetrating the bottom portion 191*c* at the center in the radial direction is formed. A flow passage tube (also referred to a flow path) 197 is formed in an annular shape and integrally formed in a circumferential edge of the penetration hole 191*d* to protrude from the internal surface of the bottom portion 191*c* to the inside of the tank 191. Accordingly, the inside of the flow passage tube 197 and the penetration hole 191*d* are communicated with each other. The flow passage tube 197 is a flow passage of the atomized aerosol. The flow passage tube 197 extends in a space from the bottom portion 191*c* to a position slightly close to the opening portion 191*a* with respect to a substantially center in the axial direction of the tank 191.

Between the internal circumferential surface of the circumferential wall 191*b* and an external circumferential surface of the flow passage tube 197, a plurality of ribs 199 (three according to the present embodiment) across the circumferential surface 191*b* and the flow passage 197 are integrally formed. The plurality of ribs 199 are disposed at equal intervals in the circumferential direction so as to be in a radial pattern viewed from the axial direction. The plurality of ribs 199 extend in a space from the bottom portion 191*c* of the tank 191 to a position slightly in front of an end portion (tip end) at the opening portion 191*a* side of the flow passage tube 197. The plurality of ribs 199 are configured to support the flow passage tube 197.

In the internal circumferential surface of the circumferential wall 191*b*, a convex portion 201 is integrally formed at the position where the ribs 199 are formed. The convex portion 201 extends along the ribs 199 in the axial direction. The convex portion 201 is formed in a space from the bottom portion 191*c* of the tank 191 to a position between an end portion (tip end) at the opening portion 191*a* side of the rib 199 and a tip end of the flow passage tube 197. The convex portion 201 functions to enhance a mechanical strength of the tank 191 while performing position alignment of the gasket 192.

The gasket 192 is formed to have an external diameter substantially the same as the internal diameter of the tank 191. The gasket 192 is configured to perform position alignment of the mesh body 193 described below while maintaining an orientation of the mesh body 193. In other words, the gasket 192 supports the mesh body 193 described below. An insertion hole 192*a* capable of being inserted by the flow passage tube 197 is formed in a center in the radial direction of the gasket 192. The gasket 192 is accommodated in the tank 191 such that the flow passage tube 197 is inserted into the insertion hole 192*a*. A surface 192*b* is abutted by the end surface 201*a* of the convex portion 201 such that position alignment of the gasket 192 in the tank 191 is performed. In the state in which the position alignment of the gasket 192 is performed, an external circumferential surface of the gasket 192 comes in contact with the internal circumferential surface of the tank 191. The insertion hole 192*a* of the gasket 192 comes in contact with the external circumferential surface of the flow passage tube 197.

A plurality of opening portions 192*c* (four according to the present embodiment) are formed in a major portion between the insertion hole 192*a* and the external circumferential surface of the gasket 192. The opening portion 192*c* is formed in an arc shape viewed from the axial direction. The plurality of opening portions 192*c* are formed by equal intervals in the circumferential direction. Two side sandwiching the gasket 192 in the tank 191 are communicated with each other via the opening portion 192*c*. The mesh body 193 is disposed on another surface 192*d* at the opposite side of the surface 192*b* of the gasket 192.

The mesh body 193 is a porous member having liquid absorbency. The mesh body 193 is formed from a cotton type fibrous material, for example. The mesh body 193 and the gasket 192 are formed in almost the same shape. In other words, the mesh body 193 is formed to have an external diameter substantially the same as the internal diameter of the tank 191. An insertion hole 193*a* into which the flow passage tube 197 is insertable is formed in a center in the radial direction of the mesh body 193. The flow passage tube 197 is inserted into the insertion hole 193*a* and a surface 193*b* of the mesh body 193 overlaps the other surface 192*d* of the gasket 192 such that position alignment of the mesh body 193 is performed. An external circumferential surface of the mesh body 193 comes in contact with the internal circumferential surface of the tank 191. The insertion hole 193*a* of the mesh body 193 comes in contact with the external circumferential surface of the flow passage tube 197.

The inside of the tank 191 is partitioned into a liquid storage room 202 at the bottom portion 191 side and an opening room 203 at the opening portion 191*a* side by the mesh body 193. The liquid aerosol source is stored in the liquid storage room 202. The opening room 203 is a room for atomizing the aerosol source suctioned by the mesh body 193.

The other surface 193*c* at the opposite side of the surface 193*c* of the mesh body 193 is exposed to the opening room 203. The heater 194 is disposed so as to be connected to the other surface 193*c* of the mesh body 193 exposed to the opening room 203.

The heater 194 is a configuration for atomizing the liquid aerosol source. The heater 194 is accommodated in the opening room 203. The heater 194 has a wick 204 formed in a substantial U shape, and an electrical heating wire 205 for heating the wick 204. The wick 204 is a porous member formed in a substantial cylindrical shape and having liquid absorbency. The wick 204 is bent and deformed to a substantial U shape.

More specifically, the wick 204 is configured by two axial-direction extending portions 204*a* extending in the axial direction and a radial-direction extending portion 204*c* by connecting two end portions of the two axial-direction extending portions 204*a* via a bending portion 204*b*. The other end of the axial-direction extending portion 204*a* is connected to the mesh body 193. Accordingly, the aerosol source absorbed by the mesh body 193 is suctioned by the wick 204.

The electrical heating wire 205 has an electrical heating wire main body 205*a* formed in a helical shape to surround the circumference of the radial-direction extending portion 204*c* of the wick 204, and two terminal portions 205*b* extending from two terminals of the electrical heating wire main body 205*a* toward the heater holder 196 side along the axial direction. When the wick 204 is heated by the electrical heating wire 205, the aerosol source absorbed by the wick 204 is atomized. Tip ends of the two terminal portions 205*b* are turned back toward the mesh body 193 side. The two terminal portions 205*b* are connected to the heater holder 196.

Figure 16:
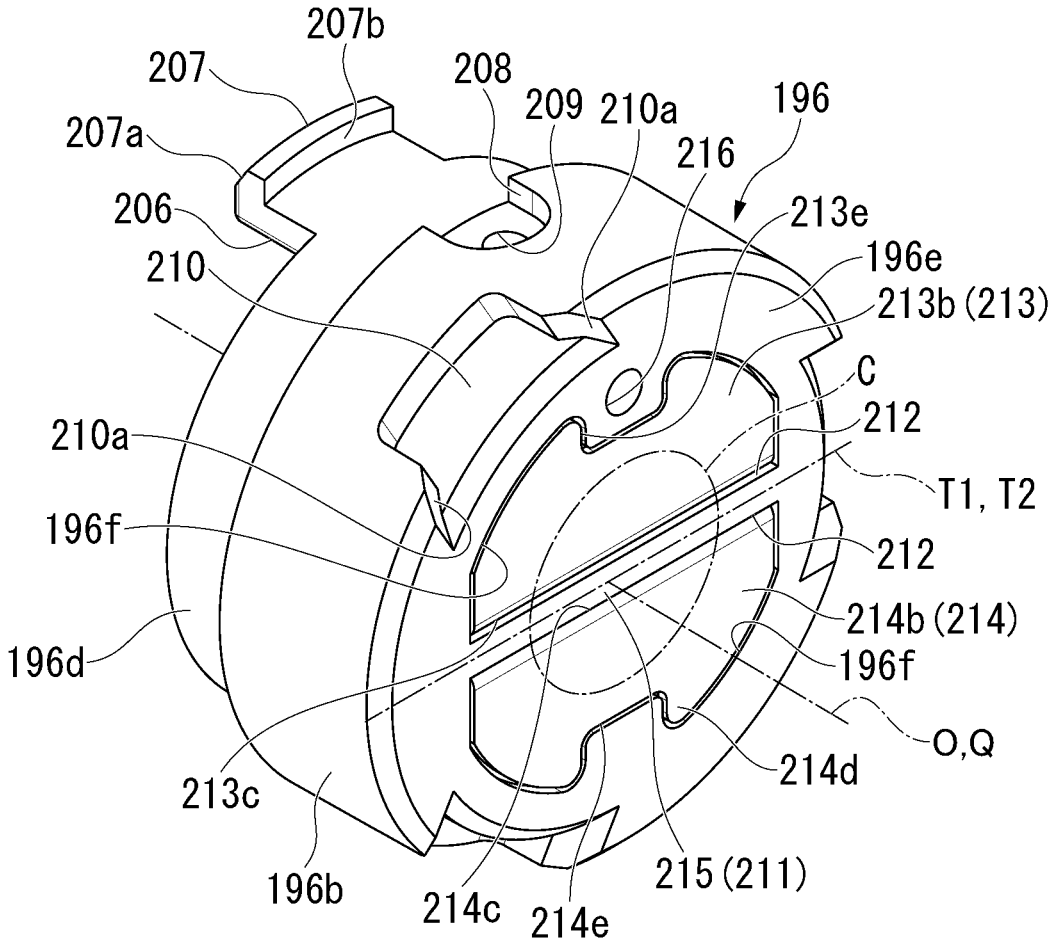
FIG. 16 is a perspective view showing a heater retainer according to the present embodiment viewed from the power unit side.

FIG. 16 is a perspective view showing the heater holder 196 viewed from the power unit 21 side (first side in the axial direction).

As shown in FIG. 13 and FIG. 16, the heater holder 196 is formed in a substantial bottomed cylindrical shape. An opening portion 196*a* of the heater holder 196 is directed to the tank 191 side and the opening portion 191*a* of the tank 191 is blocked.

A circumferential wall 196*b* of the heater holder 196 is formed to have an external diameter substantially the same as the external diameter of the circumferential wall 191*b* of the tank 191. A fitting portion 196*d* whose diameter is reduced via a step surface 196*c* is formed in a space between a substantial center and the opening portion 196 in the external circumferential surface of the circumferential wall 196*b*. The fitting portion 196*d* is fitted into the internal circumferential surface of the circumferential wall 191*b* in the tank 191. An end portion at the opening portion 191*a* side in the circumferential wall 191*b* of the tank 191 is in contact with the step surface 196*c* of the circumferential wall 196*b*. Accordingly, position alignment of the heater holder 196 with respect to the tank 191 in the axial direction is performed.

Two engagement pieces 206 are integrally formed at positions corresponding to the two engagement holes 198 of the tank 191 in an end portion at the opening portion 196*a* side of the fitting portion 196*d*. The two engagement pieces 206 protrude toward the corresponding engagement holes 198. In other words, the two engagement pieces 206 are disposed to be opposite to each other at two side of the axis Q of the heater holder 196 to sandwich the axis Q.

The engagement pieces 206 is engaged with the engagement holes 198 of the tank 191 so as to integrate the tank 191 with the heater holder 196. The engagement pieces 206 are formed to be elastically deformable in the radial direction. An engagement claw 207 insertable into the engagement hole 198 of the tank 191 is formed at a tip end of the engagement piece 206 to protrude outwardly in the radial direction.

The engagement claw 207 is formed to have a triangle cross-sectional shape corresponding to a planar surface defined by the axial direction and the radial direction. In other words, the engagement claw 207 has a surface at a tip end side formed as an inclined surface 207*a* that is inclined toward the base end side (the fitting portion 196*d* side) towards the outward in the radial direction. On the other hand, a flat surface 207*b* at the base end side of the engagement claw 207 is orthogonal with the axial direction.

A concave portion 208 arranged in the axial direction with the engagement claw 207 is formed in part of an external circumferential surface apart from the fitting portion 196*d* in the circumferential wall 196*b* of the heater holder 196. The concave portion 208 opens toward the outward in the radial direction and the step surface 196*c* side. A first air-suction hole 209 penetrating the circumferential wall 196*b* in the thickness direction is formed in the concave portion 208. The inside and the outside of the circumferential wall 196*b* are communicated via the first air-suction hole 209.

Three engagement concave portions 210 are formed at a bottom portion 196*e* side in the circumferential wall 196*b* of the heater holder 196. The three engagement concave portions 210 are disposed by equal intervals in the circumferential direction (by 120-degree intervals in the circumferential direction) and at positions apart from the positions where the concave portion 208 is formed. The engagement concave portions 210 are formed to open toward the outward in the radial direction and the bottom portion 196*e* side. A tapered flattening portion 210*a* is formed at the bottom portion 196*e* side of the engagement concave portion 210 such that the width of the engagement concave portion 210 in the circumferential direction gradually becomes wider towards the bottom portion 196*e*.

The vertical engagement convex portions (convex portions) 101*a*-101*c* of the first connection member 81 are inserted into the three engagement concave portions 210 respectively. Accordingly, the heater holder 196 (cartridge 11) is connected with the first connection member 81 while position alignment of the heater holder 196 (cartridge 11) and the first connection member 81 in the circumferential direction is performed.

In the bottom portion 196*e* of the heater holder 196, a connection wall 211 is integrally formed in a substantial plate shape standing from the internal surface in the axial direction. The connection wall 211 extends along the radial direction through the axis Q of the heater holder 196, and two ends in the longitudinal direction of the radial direction are connected to the internal surface of the circumferential wall 196*b*. The inside of the heater holder 196 is partitioned into two rooms by such connection wall 211.

In the bottom portion 196*e* of the heater holder 196, two slits 212 are formed. The two slits 212 are disposed on two surfaces in the plate-thickness direction of the connection wall 211.

Electrodes 213, 214 are disposed on the two surfaces in the plate-thickness direction of the connection wall 211 respectively. The electrodes 213, 214 have extraction electrodes 213*a*, 214*a* disposed on the connection wall 211 and connection electrodes (first planar electrode and second planar electrode) 213*b*, 214*b* extending in a bending manner from the extraction electrodes 213*a*, 214*a* to the external surface of the bottom portion 196*e* via the corresponding slits 212 respectively. Two terminal portions 205*b* of the electrical heating wires 205 configuring the heater 194 are connected to the extraction electrodes 213*a*, 214*a* respectively.

The connection electrodes 213*b*, 214*b* are formed in a substantially semicircular shape at two sides in the radial direction to sandwich an insulation portion 215 described below. More specifically, the two connection electrodes 213*b*, 214*b* are disposed to cause sides 213*c*, 214*c* in a linear shape when viewed from the axial direction to face each other in the radial direction. Two connection electrodes 213*b*, 214*b* are disposed to cause arc-shaped sides 213*d*, 214*d* in an arc shape when viewed from the axial direction to configure an external circumferential portion. An end portion of the connection wall 211 is interposed between the sides 213*c*, 214*c* of the two connection electrodes 213*b*, 214*b*. A tip end of the pin electrode (electrode main body) 49 held by each electrode retainer 50 is in contact with each of the connection electrodes 213*b*, 214*b* in a state in which the heater holder 196 (cartridge 11) is connected with the first connection member 81. In other words, the bottom portion 196*e* of the heater holder 196 functions as an electrode configuration surface (second electrode configuration surface) being opposite to the base surface 91*a* in the axial direction in a state in which the cartridge 11 is attached to the main body unit 10.

Each of the connection electrodes 213*b*, 214*b* is at least formed on a rotation locus of the pin electrode 49 (first pin electrode 49*a* and second pin electrode 49*b*) in a case when the power unit 21 and the cartridge 11 are relatively rotated around the axis O (axis Q). In other words, each of the connection electrodes 213*b*, 214*b* is formed in a region including both of a first virtual circle C1 with the axis O as a center and through the first pin electrode 49*a*, and a second virtual circle C2 with the axis O as a center and through the second pin electrode 49*b*. According to the present embodiment, the pin electrodes 49*a*, 49*b* are disposed in a line symmetry manner such that the virtual circles C1, C2 are coincided with each other.

The end portion of the connection wall 211 interposed between the sides 213*c*, 214*c* of the two connection electrodes 213*b*, 214*b* extends along the radial direction through the axis Q of the heater holder 196; in other words, the connection wall 211 is disposed on a virtual straight line T1 in a predetermined direction among the virtual straight lines T1 connecting two pin electrodes 49. The predetermined direction is coincided with a virtual straight line T2 through a center in the circumferential direction of one engagement concave portion 210 among the three engagement concave portions 210 formed in the heater holder 196 and the axis Q of the heater holder 196. The connection wall 211 is formed with a width in a short direction (circumferential direction around the axis Q) that is a little larger than a diameter of each pin electrode 49.

The end portion of the connection wall 211 is disposed in this way to function as the insulation portion 215 partitioning the connection electrodes 213*b*, 214*b* in the circumferential direction. By disposing the insulation portion 215 on the virtual straight line T2 through the center in the circumferential direction of one engagement concave portion 210 and the axis Q of the heater holder 196, the two connection electrodes 213*b*, 214*b* are definitely in contact with the tip ends of each pin electrode 49 respectively in the state in which the heater holder 196 (cartridge 11) and the first connection member 81 are connected with each other. In other words, there is no possibility for either of the two connection electrodes 213*b*, 214*b* to come in contact with the two pin electrodes 49 simultaneously. In this manner, the connection electrodes 213*b*, 214*b* are formed in a semicircular shape at two sides of the radial direction to sandwich the virtual straight line T2 (insulation portion 215) and include the virtual circles C1, C2, and expand outwardly (arc-shaped sides 213*d*, 214*d*) and inwardly (sides 213*c*, 214*c*) in the radial direction.

Concave portions 213*e*, 214*e* recessed inwardly in the radial direction are formed in a substantial center in the circumferential direction in the arc-shaped sides 213*d*, 214*d* of the two connection electrodes 213*b*, 214*b*. In the bottom portion 196*e* of the heater holder 196, a second air-suction hole 216 penetrating the bottom portion 196*e* in the thickness direction is formed at a position corresponding to one concave portion 213*e* between the positions corresponding to the concave portions 213*e*, 214*e* of the connection electrodes 213*b*, 214*b*. The inside and the outside of the bottom portion 196*e* are communicated via the second air-suction hole 216.

A concave portion 196*f* having the same shape with the connection electrodes 213*b*, 214*b* viewed from the axial direction is formed at the position corresponding to the connection electrodes 213*b*, 214*b* in the bottom portion 196*e*. The connection electrodes 213*b*, 214*b* are accommodated in the concave portion 196*f* By forming the concave portion 196*f*, surfaces of the connection electrodes 213*b*, 214*b* and a surface of a portion of the bottom portion 196*e* where the connection electrodes 213*b*, 214*b* are not disposed are positioned on the same plane. A portion of the atomization container 195 is accommodated so as to be fitted in the internal circumferential surface of the circumferential wall 196*b* in the heater holder 196.

As shown in FIG. 11, the external circumferential portion of the bottom portion 196*e* comes in contact with the surrounding convex portion 93 in the axial direction in the state in which the cartridge 11 is attached in the retention unit 22. Accordingly, a space surrounded by the bottom portion 196*e* and the connection cap 80 (the base surface 91*a* and the surrounding convex portion 93) forms a buffer space S3 communicating the communication port 51 and the second air-suction hole 216. In the example shown in FIG. 11, the communication port 51 and the second air-suction hole 216 are separate from each other in the axial direction and disposed at positions departing from each other in the circumferential direction. The communication port 51 and the second air-suction hole 216 may be disposed at positions departing from each other in the radial direction.

The communication port 51 according to the present embodiment is communicated with the inside of the flow passage tube 197 via the buffer space S3 and the second air-suction hole 216. A portion of the bottom portion (second surface) 196*e* in contact with the surrounding convex portion 93 is formed in a flat surface orthogonal with the axial direction. The portion of the bottom portion 196*e* in contact with the surrounding convex portion 93 may be a convex surface, a concave surface, an inclined surface or the like.

According to the present embodiment, the surrounding convex portion 93 is in close contact with the bottom portion 196*e* in an elastically deformation state since the cartridge 11 is pressed by the mouthpiece 23. The surrounding concave portion 93 and the bottom portion 196*e* do not have to be in close contact with each other and may be separated from each other. In other words, if it is possible to generate a negative pressure in the pressure change room S1 via the communication port 51 during the suction, a micro gap may be generated between the surrounding convex portion 93 and the bottom portion 196*e*.

Figure 17:
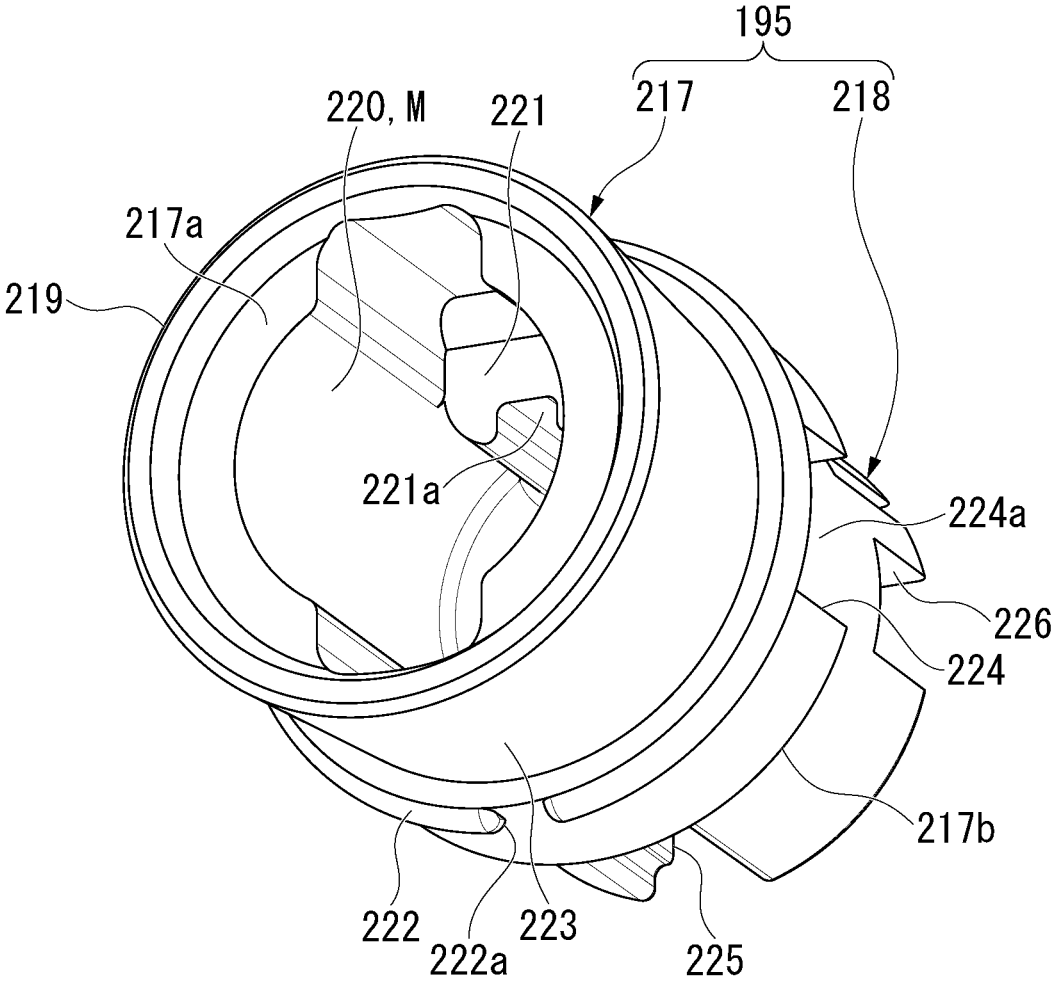
FIG. 17 is a perspective view showing an atomization container according to the present embodiment viewed from a mesh body side.

FIG. 17 is a perspective view showing the atomization container 195 viewed from the mesh body 193 side (second side in the axial direction).

The atomization container 195 shown in FIG. 13, FIG. 14, and FIG. 17 is formed from the resin material having the elasticity such as the silicone resin or the like. The atomization container 195 is disposed in a space between the other surface 193*c* of the mesh body 193 and the vicinity of the bottom portion 196*e* of the heater holder 196 in the axial direction. In other words, the atomization container 195 is formed in a substantial cylindrical shape so as to surround the circumference of the heater 194, and the atomization container 195 is integrally formed by a cylinder portion 217 fitting to the internal circumferential surface of the circumferential surface 191*b* in the tank 191 and a fitting portion 218 in a substantial block shape and fitting to the internal circumferential surface of the circumferential surface 196*b* in the heater holder 196.

A step surface 217*a* is formed in a major portion at a center in the radial direction in an end portion at the mesh body 193 side of the cylinder portion 217. By forming the step surface 217*a*, a protrusion portion 219 in a ring shape is formed that the external circumferential portion of the cylinder portion 217 protrudes toward the liquid retaining boy 193 side. An end portion of the protrusion portion 219 is in contact with the other surface 193*c* of the mesh body 193. An external diameter of the protrusion portion 219 is substantially the same or a little smaller than the internal diameter of the circumferential wall 191*b* in the tank 191.

An accommodation concave portion 220 is formed in a major portion of the step surface 217*a* corresponding to the shape of the heater 194. The accommodation concave portion 220 becomes an atomization room M configured to store the aerosol atomized by the heater 194. The atomization room M is communicated with the flow passage tube 197 of the tank 191.

A bearing surface 221 to which the bending portion 204*b* of the wick 204 configuring the heater 194 is placed is formed in the accommodation concave portion 220. A concave portion 221*a* for avoiding interference of the terminal portion 205*b* of the electrical heating wire 205 configuring the heater 194 is formed in a surface at the internal side in the radial direction of the bearing surface 221.

A seal portion 222 being close to the fitting portion 218 is formed in the external circumferential surface of the cylinder portion 217. The seal portion 222 is formed across the whole circumference except for a notch portion 222*a* described below and to protrude outwardly in the radial direction. The seal portion 222 functions to secure a sealing performance between the cylinder portion 217 and the circumferential wall 191*b* of the tank 191, and functions to prevent the atomization container 195 from slipping from the tank 191.

An external diameter of the sealing portion 222 is a little larger than the internal diameter of the circumferential wall 191*b* of the tank 191. Accordingly, in a state in which the atomization container 195 is accommodated in the tank 191, the seal portion 222 is compressed in the axial direction. Therefore, the sealing performance of the seal portion 222 is secured, and the slipping of the atomization container 195 from the tank 191 is prevented due to the friction resistance of the seal portion 222.

Two notch portions 222*a* are formed in the seal portion 222. The two notch portions 222*a* are disposed to be opposite to each other at two sides of the axis Q of the tank 191 to sandwich the axis Q. The external air and a liquid accumulation portion 223 described below are communicated with each other by the notch portions 222*a*.

The liquid accumulation portion 223 is formed in the external circumferential surface of the cylinder portion 217 between the tip end of the protrusion portion 219 and the seal portion 222. The liquid accumulation portion 223 is configured to temporarily accumulate leaked aerosol source in a case in which the liquid aerosol source stored in the liquid storage room 202 of the tank 191 is leaked via the internal circumferential surface of the circumferential wall 191*b* of the tank 191 when the mesh body 193 and the wick 204 are saturated.

The liquid accumulation portion 223 is a concave portion configured by obliquely forming the whole external circumferential surface of the cylinder portion 217 such that a gap between the external circumferential surface of the cylinder portion 217 and the circumferential wall 191*b* of the tank 191 gradually becomes narrower from the seal portion 222 toward the tip end of the protrusion portion 219. In other words, the liquid accumulation portion 223 is the concave portion where the gap between the external circumferential surface of the cylinder portion 217 and the circumferential wall 191*b* of the tank 191 gradually becomes wider towards the opening portion 191*a* of the tank 191.

Since the liquid accumulation portion 223 is formed in this manner, a narrow portion 279 where a micro gap is generated between the protrusion portion 219 and the circumferential wall 191*b* of the tank 191 is formed in the vicinity of the protrusion portion 219 of the cylinder portion 217.

The end portion of the protrusion portion 219 in the cylinder portion 217 is in contact with the other surface 193*c* of the mesh body 193. The external circumferential surface of the mesh body 193 is in contact with the internal circumferential surface of the tank 191. Accordingly, the narrow portion 279 formed between the protrusion portion 219 of the cylinder portion 217 and the circumferential wall 191*b* of the tank 191 is covered (blocked) by the external circumferential portion of the mesh body 193.

A concave portion 224 receiving the engagement piece 206 is formed at a position corresponding to the engagement piece 206 at the heater holder 196 side more than the seal portion 222 in the external circumferential surface of the cylinder portion 217. The engagement piece 206 is inserted into the concave portion 224 such that position alignment of the atomization container 195 and the heater holder 196 in the circumferential direction is performed. A bottom surface 224*a* of the concave portion 224 in the cylinder portion 217 is in contact with the internal surface of the engagement piece 206 at the internal side in the radial direction.

The fitting portion 218 of the atomization container 195 is formed in a substantial cylindrical shape capable of fitting into the internal circumferential surface of the circumferential wall 196*b* in the heater holder 196. In other words, the fitting portion 218 is formed that an external diameter is reduced than the external diameter of the cylinder portion 217 via the step portion 217*b*. A slit 225 being insertable into the connection wall 211 of the heater holder 196 is formed in the fitting portion 218. A slit for electrical heating wire that is not shown in figures and communicates with the slit 225 is formed in the fitting portion 218, and the terminal portion 205*b* of the electrical heating wire 205 is insertable into the slit for electrical heating wire. By inserting the terminal portion 205*b* of the electrical heating wire 205 into the slit for electrical heating wire, the terminal portion 205*b* is held by the atomization container 195. The extraction electrodes 213*a*, 214*a* disposed in the connection wall 211 and the terminal portion 205*b* of the electrical heating wire 205 are connected.

A ventilation passage 226 is formed at a position in the fitting portion 218 corresponding to the first air-suction hole 209 of the heater holder 196 and the second air-suction hole 216. A slit 218*a* communicating the slit 225 and the ventilation passage 226 with the atomization room M (accommodation concave portion 220) of the cylinder portion 217 is formed in the fitting portion 218. The ventilation passage 226 and the atomization room M (accommodation concave portion 220) of the atomization container 195 are communicated via the slit 218*a*. Accordingly, the atomization room M (accommodation concave portion 220) of the atomization container 195 is communicated with the first air-suction hole 209 and the second air-suction hole 216 of the heater holder 196 via the ventilation passage 226 and the slit 218*a*.

(Overall Assembly Structure of Suction Device)

Figure 18:
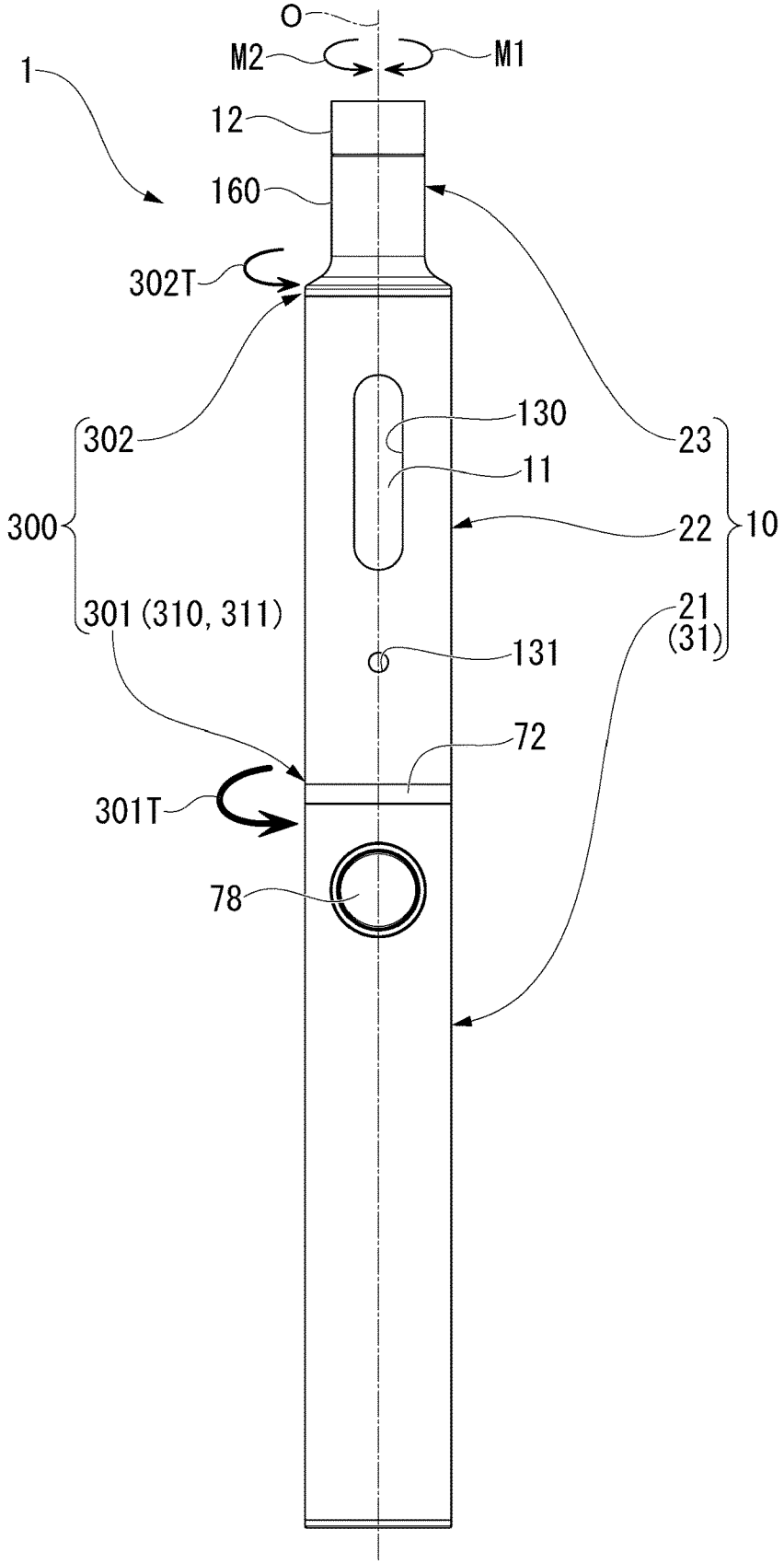
FIG. 18 is a front view showing a suction device according to the present embodiment.

FIG. 18 is a front view of the suction device 1.

As shown in FIG. 18, the main body unit 10 of the suction device 1 has a connection portion 300 configured to connect the power unit 21, the retention unit 22, and the mouthpiece 23 in the axial direction along the axis O (center axis). The connection portion 300 has a first rotation connection portion 301 connecting the power unit 21 and the retention unit 22 and a second rotation connection portion 302 connecting the retention unit 22 and the mouthpiece 23.

In the description hereinafter, in a planar view viewing the power unit 21 side from the mouthpiece 23 side along the axis O, in the circumferential direction around the axis O, a clockwise direction rotating around the axis O is referred to as a rotation direction M1, and a counter-clockwise direction rotating around the axis O is referred to as a rotation direction M2.

The first rotation connection portion 301 is configured to perform a connection and release the connection of the power unit 21 and the retention unit 22 by a relative rotation of the power unit 21 and the retention unit 22 around the axis O. In a case of taking the power unit 21 as a reference, when the retention unit 22 is rotated in the rotation direction M1 with respect to the power unit 21, the power unit 21 and the retention unit 22 are connected. When the retention unit 22 is rotated in the rotation direction M2 with respect to the power unit 21, the connection of the power unit 21 and the retention unit 22 is released.

The first rotation connection portion 301 has a rotation connection mechanism 310 configured by the first connection member 81 and the second connection member 122 shown in FIG. 9, and a lock mechanism 311 configured by the annular piece 82 and the second connection member 122 shown in FIG. 9 and FIG. 10. More specifically, as shown in FIG. 9, the rotation connection mechanism 310 is configured to insert the horizontal engagement convex portion 102 disposed in the first connection member 81 of the power unit 21 into the engagement groove 158 formed in the second connection member 122 of the retention unit 22, and then rotate the retention unit 22 in the rotation direction M1 (see FIG. 18) with respect to the power unit 21 so as to engage the horizontal engagement convex portion 102 to the locking piece 142 and connect the power unit 21 with the retention unit 22.

The lock mechanism 311 is configured to restrict the rotation of the retention unit 22 in the rotation direction M2 for releasing the connection by the rotation connection mechanism 310. More specifically, as shown in FIG. 9 and FIG. 10, the lock mechanism 311 has the bending portion 106 disposed in the annular piece 82 attached to the power unit 21 and protruding outwardly in the radial direction, and a tip end portion 142*a* disposed in the second connection member 122 of the retention unit 22 and protruding inwardly in the radial direction relatively with respect to a bottom portion of the engagement concave portion 155 in the locking piece 142. The tip end portion 142*a* of the locking piece 142 is positioned in a movement passage of the bending portion 106 around the axis O.

At the time of the connection in the rotation connection mechanism 310 (when the retention unit 22 is rotated in the rotation direction M1 with respect to the power unit 21), the bending portion 106 and the tip end portion 142*a* of the locking piece 142 come in contact with each other and the bending portion 106 climbs over the tip end portion 142*a* while elastically deforming inwardly in the radial direction. The bending portion 106 deforms outwardly in the radial direction after overcoming the tip end portion 142*a* to restore the shape and engages with the engagement concave portion 155. When the bending portion 106 engages with the engagement concave portion 155, the bending portion 106 and the tip end portion 142*a* of the locking piece 142 are locked in the rotation direction M1 to be opposite with each other. Accordingly, it is impossible to release the connection of the power unit 21 and the retention unit 22 without applying a certain force.

According to the first rotation connection portion 301, in order to improve manufacturing efficiency or the like, as shown in the present embodiment, even if the power unit 21 and the retention unit 22 are capable of being divided, it is possible to make the connection of the power unit 21 and the retention unit 22 by the rotation connection mechanism 310 easy and improve reliability (connection strength) of the connection state of the power unit 21 and the retention unit 22 by the lock mechanism 311. The locking by the lock mechanism 311 is performed simultaneously with the connection by the rotation connection mechanism 310 such that convenience (usability) of the assembly may be improved.

As shown in FIG. 10, in the lock mechanism 311, the bending portion 106 elastically deforming is disposed at the internal side in the radial direction of the locking piece 142 having a larger thickness and higher rigidness than the annular piece 82. Accordingly, in a state in which the power unit 21 and the retention unit 22 are connected, the bending portion 106 is covered by the locking piece 142 from the external side and protected. Accordingly, even if falling, collision or the like occurs, a number of cases such as the bending portion 106 being damaged become less. Accordingly, strength for repeatedly using the assembly is secured and the reliability of locking is improved.

As shown in FIG. 9, the lock piece 142 configured to lock the bending portion 106 has the engagement groove 158 to which the horizontal engagement convex portion 102 of the rotation connection mechanism 310 is engaged. In this manner, the lock piece 142 forms a portion (engagement groove 158) of the rotation connection mechanism 310 while forms a portion (tip end portion 142*a* (convex portion)) of the lock mechanism 311 such that it is relatively easy to improve the reliability (connection strength) of the connection state.

As shown in FIG. 18, the second rotation connection member 302 is configured to perform a connection and release the connection between the retention unit 22 and the mouthpiece 23 by the relative rotation of the retention unit 22 and the mouthpiece 23 around the axis O. In a case of taking the retention unit 22 as a reference, when the mouthpiece 23 is rotated in the rotation direction M1 with respect to the retention unit 22, the retention unit 22 and the mouthpiece 23 are connected. When the mouthpiece 23 is rotated in the rotation direction M2 with respect to the retention unit 22, the connection of the retention unit 22 and the mouthpiece 23 is released.

As shown in FIG. 11, the second rotation connection portion 302 has a male screw portion 160*a* disposed in the mouthpiece 23 and a female screw portion 123*a* disposed in the retention unit 22. More specifically, the second rotation connection portion 302 is configured to connect the retention unit 22 and the mouthpiece 23 by rotating the male screw portion 160*a* disposed in the mouthpiece 23 in the rotation direction M1 with respect to the female screw portion 123*a* disposed in the retention unit 22. The second rotation connection portion 302 is configured to release the connection of the retention unit 22 and the mouthpiece 23 by rotating the male screw portion 160*a* disposed in the mouthpiece 23 with respect to the female screw portion 123*a* disposed in the retention unit 22.

As shown in FIG. 18, the rotation direction M1 is a connection direction of the retention unit 22 with respect to the power unit 21 and also a connection direction of the mouthpiece 23 with respect to the retention unit 22. The rotation direction M2 is a connection releasing direction of the retention unit 22 with respect to the power unit 21 and also a connection cancelling direction of the mouthpiece 23 with respect to the retention unit 22. In this manner, the rotation directions for the connection and releasing the connection around the axis O in the first rotation connection portion 301 and the second rotation connection portion 302 are the same as each other. Accordingly, it is possible to provide a unified sense of the assembly operation to the user and improve the convenience (usability).

For a replacement of the cartridge 11 or the like, a frequency of releasing the connection of the mouthpiece 23 and the retention unit 22 is higher than a frequency of releasing the connection of the power unit 21 and the retention unit 22. According to the present embodiment, the connection of the power unit 21 and the retention unit 22 is released by applying a first torque 301T around the axis O in the first rotation connection portion 301, and the connection of the retention unit 22 and the mouthpiece 23 is released by applying a second torque 302T that is smaller than the first torque 301T in the second rotation connection portion 302. Accordingly, it is possible to prevent co-rotation of the retention unit 22 and the power unit 21 at the time of detaching the mouthpiece 23 from the retention unit 22.

The first torque 301T is a peak value of a torque value when the retention unit 22 is rotated in the rotation direction M2 with respect to the power unit 21, and the first torque 301T depends on a spring modulus or the like corresponding to the elastically deformation in the radial direction of the bending portion 106 as shown in FIG. 9 and FIG. 10. The second torque 302T is a peak value of a torque value when the mouthpiece 23 is rotated in the rotation direction M2 with respect to the retention unit 22, and the second torque 302T depends on a static friction force or the like between the male screw portion 160*a* and the female screw portion 123*a* as shown in FIG. 11. It is preferable that the first torque 301T is 1.5 times larger than the second torque 302T, for example.

The first rotation connection portion 301 and the second rotation connection portion 302 are different in connection structure such that it is easy to adjust a magnitude relationship between the first torque 301T and the second torque 302T. For example, if a material selection and a thickness adjustment of the bending portion 106 (annular piece 82) configuring the lock mechanism 311 of the first rotation connection portion 301 is performed, the spring modulus of the bending portion 106 corresponding to the elastically deformation in the radial direction is changed and it is easy to adjust the magnitude of the first torque 301T with respect to the second torque 302T.

Figure 19:
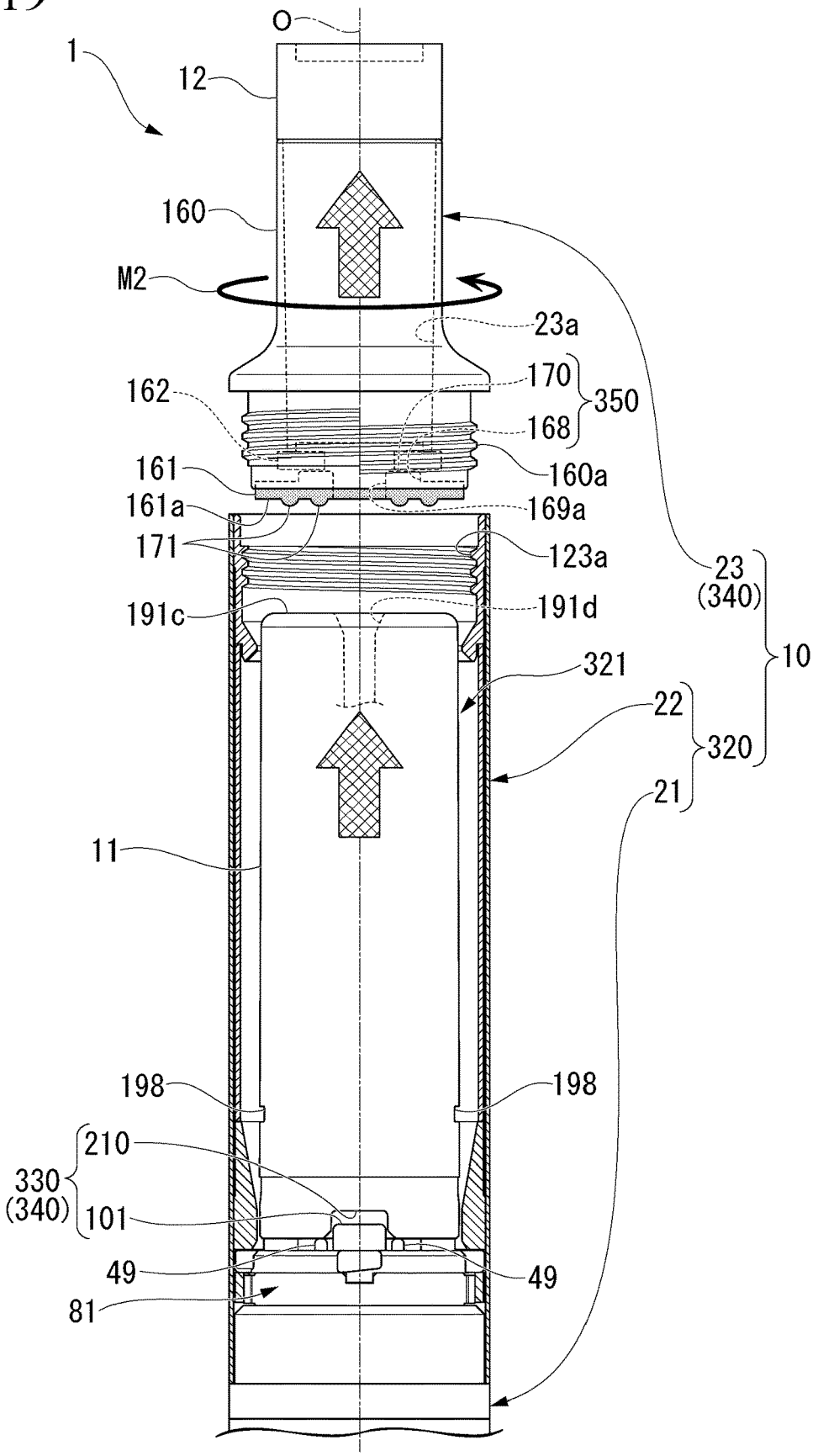
FIG. 19 is a cross-sectional view along the axial direction when the mouthpiece is detached from the suction device.

FIG. 19 is a cross-sectional view along the axial direction when the mouthpiece 23 is removed from the suction device 1.

As shown in FIG. 19, in the suction device 1, the cartridge 11 is attachable and detachable in the axial direction by removing the mouthpiece 23 from the main body unit 10. A configuration for removing the mouthpiece 23 from the main body unit 10 is referred to as a cartridge accommodation portion 320. In other words, the cartridge accommodation portion 320 has the retention unit 22 and the power unit 21.

The cartridge accommodation portion 320 forms a cartridge accommodation space 321 in a bottomed cylindrical shape. A circumferential wall of the cartridge accommodation portion 320 forming the cartridge accommodation space 321 is formed by the retention unit 22. A bottom portion of the cartridge accommodation portion 320 forming the cartridge accommodation space 321 is formed by the power unit 21. In other words, the circumferential wall (retention unit 22) of the cartridge accommodation portion 320 is attachable to and detachable from the bottom portion (power unit 21) of the cartridge accommodation portion 320.

The vertical engagement convex portion 101 (the vertical engagement convex portion 101*a*-101*c* are designated to the reference sign 101 after FIG. 19) disposed in the first connection member 81 is formed to stand in the axial direction in the bottom portion of the cartridge accommodation portion 320. The vertical engagement convex portion 101 is disposed to be insertable into the engagement concave portion 210 disposed in the cartridge 11 in the axial direction. In other words, the vertical engagement convex portion 101 and the engagement concave portion 210 are disposed on the same radius with the axis O as a center. The vertical engagement convex portion 101 and the engagement concave portion 210 form a first rotation restriction portion 330 for restricting a relative rotation of the cartridge 11 around the axis O with respect to the cartridge accommodation portion 320 (cartridge accommodation space 321).

In the first rotation restriction portion 330, when the cartridge 11 and the cartridge accommodation portion 320 are relatively rotated around the axis O, the vertical engagement convex portion 101 is inserted into the engagement concave portion 210 disposed on the same radius and the restriction for the rotation of the cartridge 11 around the axis O is performed. Accordingly, position alignment of the cartridge 11 in the circumferential direction is performed, and electrical conduction of the connection electrodes 213*b*, 214*b* (see FIG. 10) of the bottom portion 196*e* of the cartridge 11 and the pin electrode 49 of the power unit 21 is secured.

The first rotation restriction portion 330 together with the mouthpiece 23 configure a position-alignment mechanism 340 for aligning positions of the cartridge 11 with respect to the cartridge accommodation portion 320 by interlocking with screwing of the mouthpiece 23 with respect to the cartridge accommodation portion 320 (retention unit 22). According to the position-alignment mechanism 340, the position alignment of the cartridge 11 may be performed simultaneously with screwing the mouthpiece 23 to the cartridge accommodation portion 320. Accordingly, the position alignment of the cartridge 11 attachable to and detachable from the cartridge accommodation portion 320 becomes easy and complicatedness of the assembling is eliminated. There is not necessity to rotate the cartridge 11 directly by hands.

More specifically, the mouthpiece 23 has the first slip prevention member (cartridge contact portion) 161 for rotating the cartridge 11 around the axis O with respect to the cartridge accommodation portion 320. The first slip prevention member 161 is attached to the mouthpiece main body 160, and the first slip prevention member 161 comes in contact with the cartridge 11 during a period when the mouthpiece main body 160 is connected to the retention unit 22. When the first slip prevention member 161 comes in contact with the cartridge 11, the cartridge 11 begins to rotate with the mouthpiece 23 together, and when a positon of the engagement concave portion 210 in the circumferential direction and a position of the vertical engagement convex portion 101 in the circumferential direction are coincided with each other, the cartridge 11 falls off toward the bottom portion side of the cartridge accommodation portion 320 due to gravity and the vertical engagement convex portion 101 is inserted into the engagement concave portion 210 so as to perform a positioning of the cartridge 11 in the circumferential direction.

When the mouthpiece 23 is screwed, the first slip prevention member 161 is compressed in the axial direction between the cartridge 11 supported by the power unit 21 (the vertical engagement convex portion 101 and the like) and the mouthpiece main body 160. As shown in FIG. 11, the first slip prevention member 161 presses the cartridge 11 toward the power unit 21 in a state in which the mouthpiece 23 is screwed with the retention unit 22. Accordingly, a positioning of the cartridge 11 in the axial direction is performed.

As described above, the first slip prevention member 161 is formed from the silicone resin such that it is easy to cause the friction force for rotating the cartridge 11 in the circumferential direction and a pressing force for pressing the cartridge 11 in the axial direction to be realized. As shown in FIG. 19, the first slip prevention member 161 has the engagement protrusion 171 formed on an opposite surface 161*a* being opposite to the cartridge 11. According to the engagement protrusion 171, a contact of the first slip prevention member 161 with respect to the cartridge 11 is not a plane contact such that a contact pressure increases and it becomes easy to realize the friction force in the circumferential direction and the pressing force in the axial direction.

As shown in FIG. 11, the engagement protrusion 171 is pressed and crushed in the axial direction such that the penetration hole 191*d* of the cartridge 11 and the communication hole 169*a* of the first slip prevention member 161 are airtightly sealed with each other, the flow passages of the cartridge 11 and the mouthpiece 23 are communicated, and the aerosol generated in the cartridge 11 is capable of being suctioned through the mouthpiece 23. The engagement protrusion 171 is formed in a double annular shape (see FIG. 12) such that a double seal having a high airtightness may be formed.

As shown in FIG. 19, the mouthpiece 23 has a second rotation restriction portion 350 for restricting a relative rotation of the first slip prevention member 161 with respect to the mouthpiece main body 160. The second rotation restriction portion 350 is formed by the fitting protrusion 170 (see FIG. 12) disposed in the first slip prevention member 161 and the oval-shaped penetration hole 168 (see FIG. 12) disposed in the mouthpiece main body 160. A pair of the fitting protrusions 170 extend toward the mouthpiece main body 160 in the axial direction and fit with two end portions in the longitudinal direction of the penetration hole 168.

According to the second rotation restriction portion 350, even if condensed aerosol is stored in a space between the mouthpiece main body 160 and the first slip prevention member 161, idling operation (slip) of the first slip prevention member 161 with respect to the mouthpiece main body 160 may be prevented. Accordingly, a positioning of the cartridge 11 in the circumferential direction may be definitely performed. The penetration hole 168 may be formed in the oval shape to be integrally formed with the suction port 23*a*.

(Assembly Method of the Suction Device)

Next, an assembly method of the suction device 1 will be described.

As shown in FIG. 2, in order to assemble the suction device 1 according to the present embodiment, the retention unit 22 is assembled to the power unit 21 at first. More specifically, after inserting the horizontal engagement convex portion 102 into the engagement groove 158 in the axial direction, the power unit 21 and the retention unit 22 are relatively rotated around the axis O. Therefore, the power unit 21 and the retention unit 22 are assembled with each other in the first rotation connection portion 301 in a state in which position alignments in the axial direction and the circumferential direction are performed. At the time of detaching the power unit 21 and the retention unit 22, operations reverse to the above-described operations are performed.

Subsequently, the cartridge 11 is inserted into the retention unit 22. More specifically, the cartridge 11 is inserted into the retention unit 22 in a state in which the connection electrodes 213*b*, 214*b* of the cartridge 11 are directed to the retention unit 22 side in the axial direction. In a case in which the positions of the vertical engagement convex portions 101*a*-101*c* of the power unit 21 and the position of the engagement concave portion 210 of the cartridge 11 are coincided with each other in the circumferential direction, each of the vertical engagement convex portions 101*a*-101*c* is inserted into the corresponding engagement concave portion 210. In the engagement concave portion 210, the flattening portion 210*a* is formed and on the other hand, inclined surfaces are formed at tip end of the vertical engagement convex portions 101*a*-101*c*. Accordingly, the vertical engagement convex portions 101*a*-101*c* are smoothly inserted into the engagement concave portion 210. Accordingly, position alignments of the cartridge 11 with respect to the power unit 21 in the circumferential direction and the axial direction are performed and the cartridge 11 is assembled with the power unit 21 at a regular position.

In other words, one pin electrode 49 of the pin electrodes 49 of the power unit 21 and either connection electrode 213*b* or 214*b* of the connection electrodes 213*b*, 214*b* in the cartridge 11 are connected with each other. The other pin electrode 49 and the other connection electrode 213*b* or 214*b* of the connection electrodes 213*b*, 214*b* in the cartridge 11 are connected with each other. The power of the power unit 21 is transmittable to the electrical heating wire 205 of the heater 194 via the connection electrodes 213*b*, 214*b* (electrodes 213, 214). The buffer space S3 is formed by the cartridge 11 and the connection cap 80 by engaging the bottom portion 196*e* of the cartridge 11 with the surrounding convex portion 93.

Subsequently, the mouthpiece 23 is assembled with the retention unit 22 by the second rotation connection portion 302. More specifically, the male screw portion 160*a* of the mouthpiece main body 160 is screwed to the female screw portion 123*a* of the sleeve 123. Therefore, the first slip prevention member 161 comes in contact with the bottom portion 191*c* of the cartridge 11. When the mouthpiece 23 is further tightened in this state, the first slip prevention member 161 is elastically deformed such that the cartridge 11 is held in the retaining in the retention unit 22 in a state in which the cartridge 11 is pressed toward the power unit 21 side in the axial direction. A movement of the cartridge 11 with respect to the power unit 21 in the circumferential direction is restricted by the vertical engagement convex portions 101*a*-101*c*. Accordingly, the cartridge 11 is configured to not to rotate following the mouthpiece 23 due to the friction force applied between the first slip prevention member 161 and the cartridge 11.

Subsequently, the tobacco capsule 12 is inserted into the mouthpiece 23. More specifically, the tobacco capsule 12 is fitted into the mouthpiece main body 160 in a state of directing the mesh opening toward the mouthpiece 23.

Therefore, the assembly of the suction device 1 is finished.

During the insertion of the cartridge 11, there is a case in which the positions of the vertical engagement convex portions 101*a*-101*c* of the power unit 21 and the position of the engagement concave portion 210 of the cartridge 11 are not coincided in the circumferential direction due to an orientation of the cartridge in the circumferential direction. In this case, the bottom portion 196*e* of the cartridge 11 enters a state of climbing over the vertical engagement convex portions 101*a*-101*c* (hereinafter simply referred to as a "climb-over state").

Figure 20:
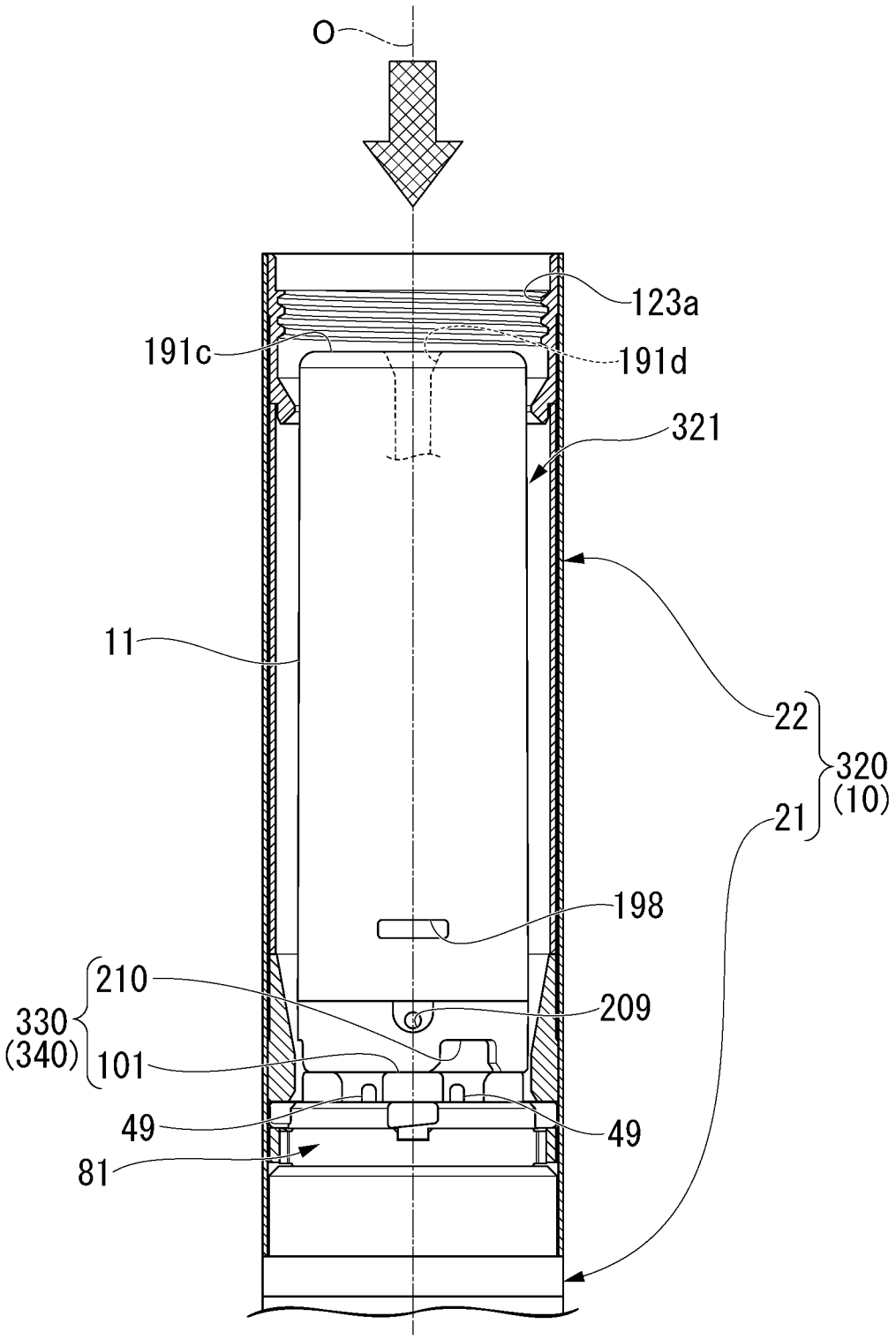
FIG. 20 is a descriptive view showing a state when the cartridge climbs over a vertical engagement convex portion.

FIG. 20 is a view showing the state in which the cartridge 11 climbs over the vertical engagement convex portion 101.

As shown in FIG. 20, in the climb-over state of the cartridge 11, movement of the cartridge 11 toward the power unit 21 side in the axial direction with respect to the power unit 21 is restricted. Accordingly, the pin electrodes 49 and the connection electrodes 213*b*, 214*b* are separated in the axial direction, and a conduction of the power unit 21 and the cartridge 11 is not secured. In the climb-over state, even in a case in which the pin electrodes 49 and the connection electrodes 213*b*, 214*b* are in contact, there is a possibility that the pin electrodes 49 and the connection electrodes 213*b*, 214*b* are not disposed in desired positions in the circumferential direction.

Figure 21:
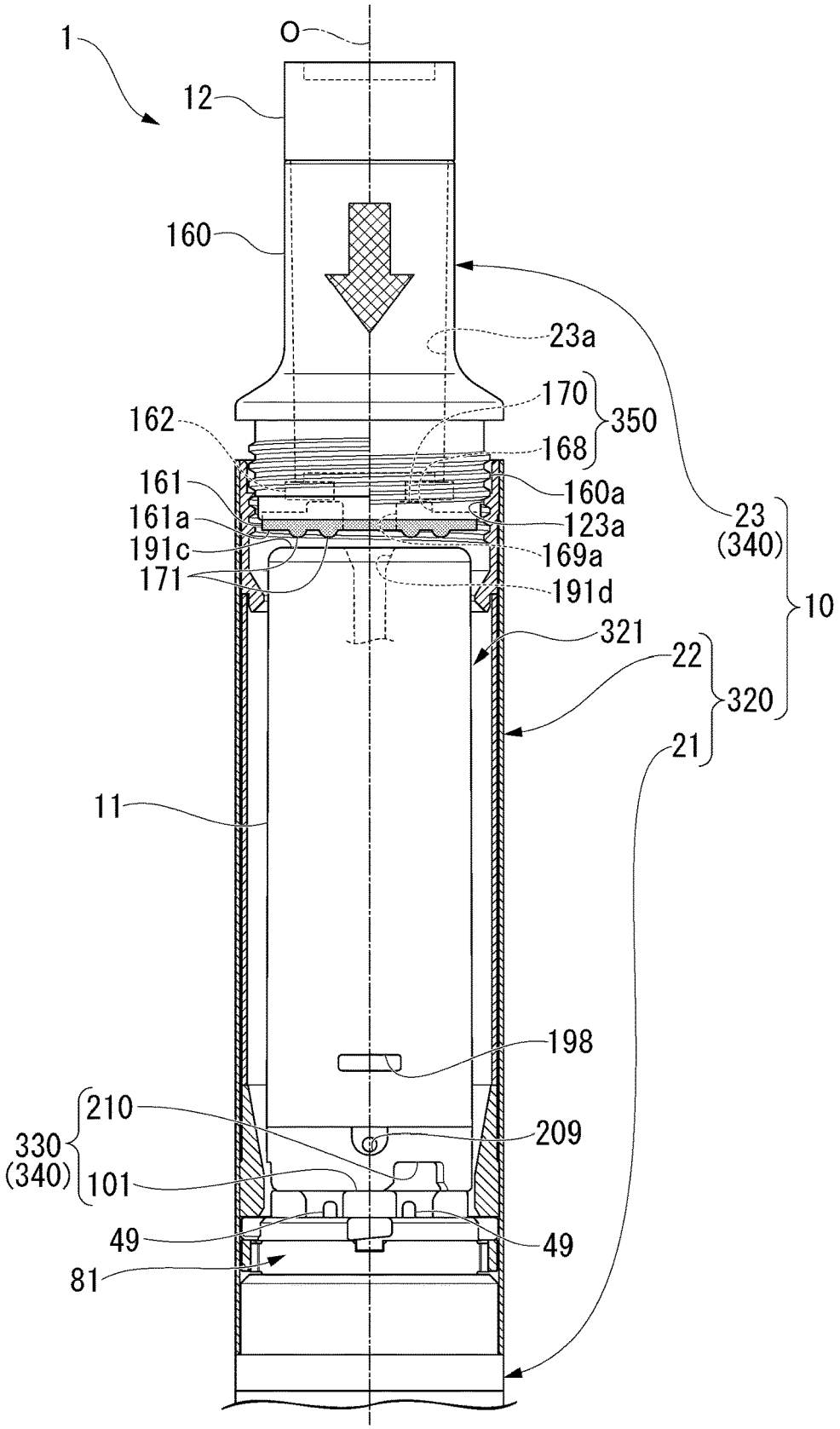
FIG. 21 is a descriptive view showing a state of screwing the mouthpiece during the climb-over state of the cartridge.

FIG. 21 is a view showing a state of screwing the mouthpiece 23 in the climb-over state of the cartridge 11.

Figure 22:
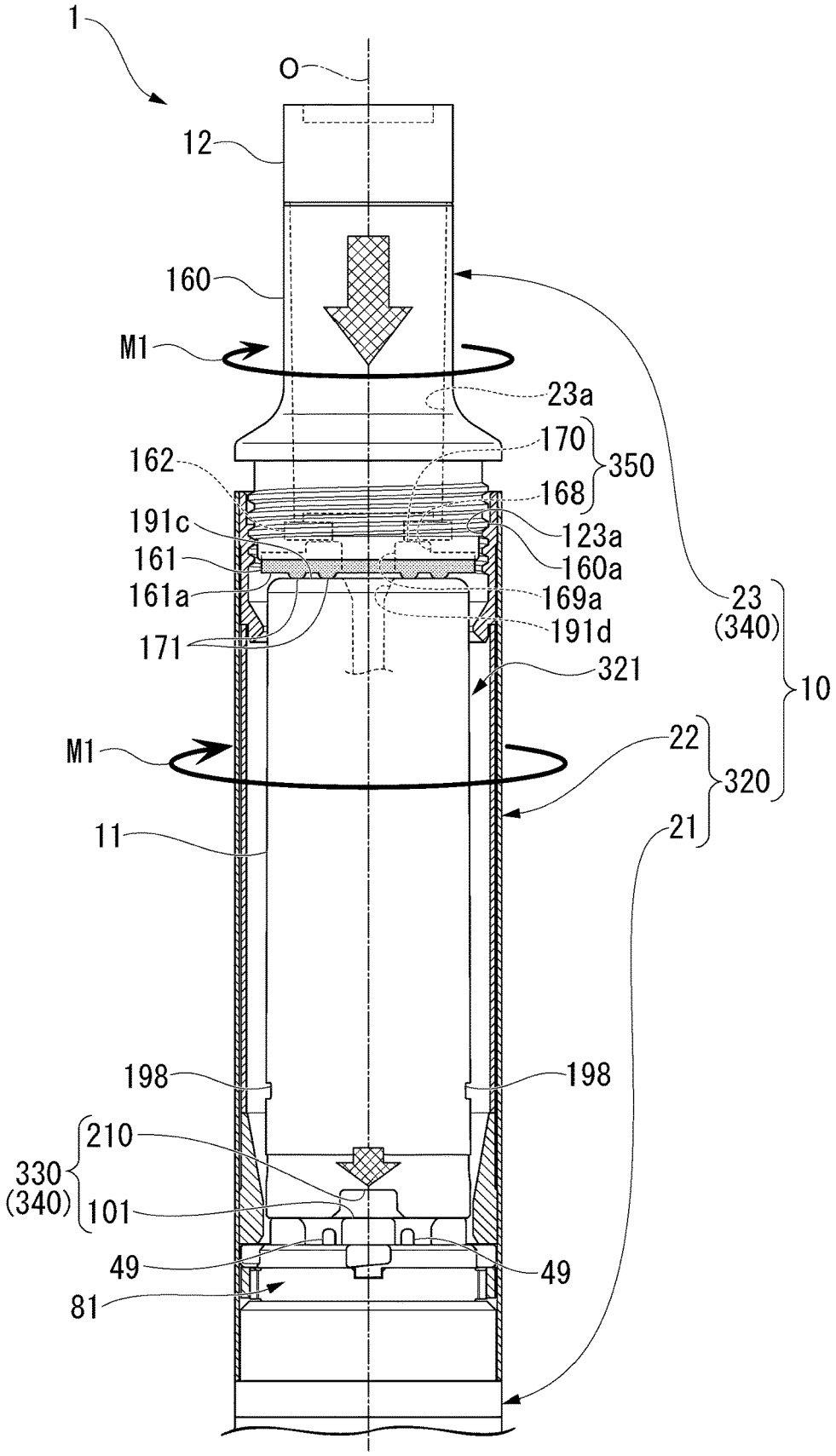
FIG. 22 is a descriptive view showing a state when the mouthpiece and the cartridge are rotated together.

As shown in FIG. 21, when the cartridge 11 is kept in the climb-over state and the mouthpiece 23 is rotated to be screwed with the retention unit 22, as shown in following FIG. 22, the first slip prevention member 161 comes in contact with the cartridge 11 at least before the screwing is finished. More specifically, as shown in FIG. 21, at a moment when the male screw portion 160*a* of the mouthpiece 23 is about to engage with the female screw portion 123*a* of the retention unit 22, the first slip prevention member is not in contact with the cartridge 11; however, as shown in FIG. 22, when the male screw portion 160*a* is screwed with the female screw portion 123*a* and rotated by a half-rotation or once or twice rotations, the first slip prevention member 161 is in contact with the cartridge 11.

FIG. 22 is a view showing a state in which the mouthpiece 23 and the cartridge 11 are rotated together.

As shown in FIG. 22, in the state in which the first slip prevention member 161 is in contact with the cartridge 11, if the screwing operation of the mouthpiece 23 is continued, the mouthpiece 23 and the cartridge 11 are rotated together due to the friction force applied between the first slip prevention member 161 and the cartridge 11. In other words, due to the screwing operation of the mouthpiece 23, the cartridge 11 is pressed toward the power unit 21 side in the axial direction and rotated in the circumferential direction (tightening direction (rotation direction M1)).

Subsequently, when the positions of the connection electrodes 213*b*, 214*b* in the circumferential direction and the positions of the vertical engagement convex portions 101*a*-101*c* in the circumferential direction are coincided with each other, the vertical engagement convex portions 101*a*-101*c* enter the corresponding engagement concave portions 210 respectively. In other words, the cartridge 11 is assembled at the regular position by allowing the movement of the cartridge 11 in the axial direction with respect to the power unit 21. Accordingly, the pin electrodes 49 and the connection electrodes 213*b*, 214*b* are in contact in a state in which the movement of the cartridge 11 in the axial direction with respect to the power unit 21 is restricted.

Figure 23:
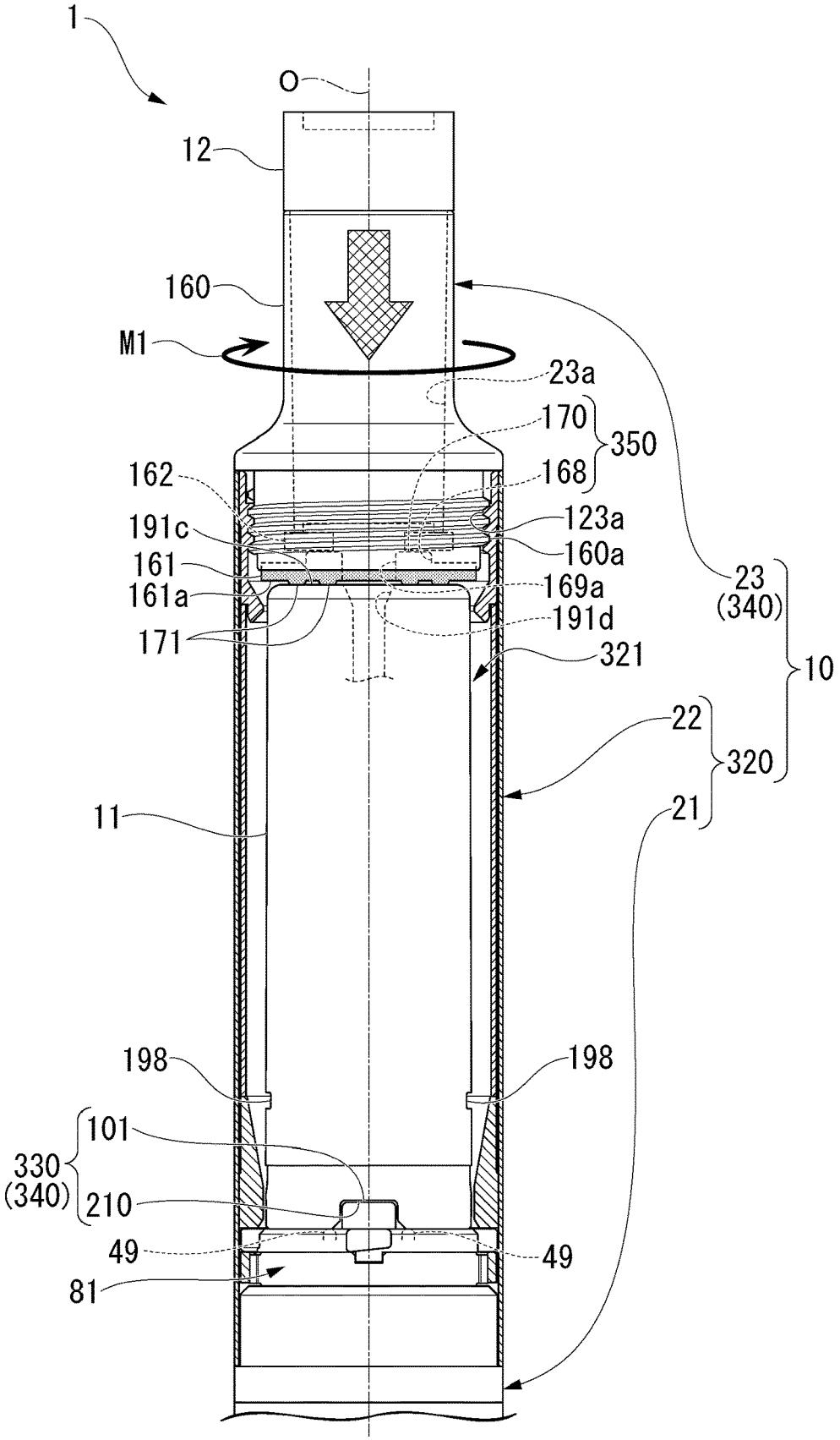
FIG. 23 is a descriptive view showing a state when the mouthpiece is finally tightened.

FIG. 23 is a descriptive view showing the state in which the mouthpiece 23 is finally tightened.

As shown in FIG. 23, due to the position alignment of the vertical engagement convex portion 101 and the engagement concave portion 210 in the circumferential direction, when the movement of the cartridge 11 in the axial direction is allowed, the mouthpiece 23 may be further screwed. When the mouthpiece 23 is finally screwed, the connection electrodes 213*b*, 214*b* are pressed by the pin electrodes 49 and the first slip prevention member 161 between the cartridge 11 supported by the power unit 21 and the mouthpiece main body 160 is compressed in the axial direction that the positioning of the cartridge 11 in the axial direction is performed. In this manner, the positioning of the cartridge 11 in the circumferential direction and the axial direction and further the electrically conduction of the cartridge 11 and the power unit 21 are performed by the screwing of the mouthpiece 23. A gap between the cartridge 11 and the mouthpiece 23 is sealed by the engagement protrusion 171 of the first slip prevention member 161 being compressed in the axial direction.

In this manner, when the cartridge 11 is assembled in the regular position, the surrounding convex portion 93 of the connection cap 80 comes in contact with the cartridge 11. Accordingly, the buffer space S3 (see FIG. 3) whose circumference is surrounded by the surrounding convex portion 93 is formed between the bottom portion 196*e* of the heater holder 196 of the cartridge 11 and the connection cap 80.

(Assembly Method of Cartridge)

Next, an assembly method of the cartridge 11 will be described.

Firstly, the liquid aerosol source is filled in the liquid storage room 202 of the tank 191, and then the gasket 192 and the mesh body 193 are inserted from the opening portion 191*a* of the tank 191 in this sequence. At this time, the surface 192*b* of the gasket 192 is in contact with the end surface 201*a* of the convex portion 201 of the tank 191. The surface 193*b* of the mesh body 193 is caused to overlap the other surface 192*d* of the gasket 192. Accordingly, the inside of the tank 191 is correctly partitioned into the liquid storage room 202 and the opening room 203 by the mesh body 193. The mesh body 193 itself is soft; however, the orientation the mesh body 193 is maintained by the gasket 192 and the poisoning thereof is performed by the gasket 192.

The heater 194 and the atomization container 195 are assembled to the heater holder 196 parallel to the above-described process. More specifically, firstly, the heater 194 is assembled to the accommodation concave portion 220 of the atomization container 195. Subsequently, the fitting portion 218 side of the atomization container 195 is directed to the opening portion 196*a* of the heater holder 196 and the atomization container 195 is inserted into the heater holder 196. The fitting portion 218 is fitted to the internal circumferential surface of the circumferential wall 196*b* in the heater holder 196. At this time, directions of the connection wall 211 of the heater holder 196 and the slit 225 of the fitting portion 218 are aligned and the connection wall 211 is inserted into the slit 225.

Subsequently, the heater holder 196 is assembled to the opening portion 191*a* of the tank 191. More specifically, the engagement piece 206 side of the heater holder 196 is directed to face the opening portion 191*a* side of the tank 191 and the heater holder 196 is inserted into the opening portion 191*a* of the tank 191. At this time, positions of the engagement hole 198 and the guide concave portion 198*a* formed in the circumferential wall 191*b* of the tank 191 and a position of the engagement piece 206 of the heater holder 196 are aligned.

When the heater holder 196 is inserted into the opening portion 191*a* of the tank 191 in this state, firstly, the inclined surface 207*a* formed in the engagement claw 207 of the engagement piece 206 comes in contact with the circumferential wall 191*b* of the tank 191. The engagement claw 207 smoothly comes in contact with the guide concave portion 198*a* of the tank 191 by the inclined surface 207*a*.

Thereafter, when the heater holder 196 is further pushed into the inside of the tank 191, the engagement claw 207 is carried in the guide concave portion 198*a*. The engagement piece 206 is pressed to be elastically deformed inwardly in the radial direction by the guide concave portion 198*a*. At this time, the engagement piece 206 is smoothly elastically deformed inwardly in the radial direction by the inclined surface 207*a* of the engagement claw 207. The two engagement pieces 206 are disposed at two sides of the axis Q to sandwich the axis Q and face each other such that it is difficult for forces applied inwardly in the radial direction to the two engagement pieces 206 to be biased when the heater holder 196 is viewed as a whole. At this time, the forces causing the engagement pieces 206 to be elastically deformed are balanced such that it is easy for the heater holder 196 to be inserted into the opening portion 191*a* of the tank 191. The bottom surface 224*a* of the concave portion 224 of the atomization container 195 is in contact with the internal surface at the internal side of the engagement piece 206 in the radial direction. Accordingly, when the engagement piece 206 is elastically deformed inwardly in the radial direction, the concave portion 224 of the atomization container 195 is slightly deformed inwardly in the radial direction.

Thereafter, when the heater holder 196 is further pushed, the engagement claw 207 moves along the guide concave portion 198*a*. Then, the engagement claw 207 climbs over a terminal end of the guide concave portion 198*a* (end portion at the engagement hole 198 side of the tank 191), and further the engagement claw 207 is inserted into the engagement hole 198 of the tank 191 by a restoring force of the engagement piece 206 and a restoring force of the concave portion 224 of the atomization container 195. Accordingly, the heater holder 196 is fixed to the tank 191 and the assembly of the cartridge 11 is finished.

In a state in which the heater holder 196 is fixed to the tank 191, a surface at the external side in the radial direction of the engagement piece 206 is covered by the circumferential wall 191*b* of the tank 191. When the engagement of either of the two engagement claws 207 is about to be released, for example, when the tank 191 or the heater holder 196 is about to be tilted so as to cause one of the engagement claw 207 to be removed from the engagement hole 198, the other engagement claw 207 is pressed outwardly in the radial direction. Accordingly, once the engagement hole 198 and the engagement piece 206 are engaged with each other, it is difficult to release the engagement.

(Usage Method of Suction Device)

When the suction device 1 is used, the user operates to press the button 78. At this time, for example, by pressing the button 78 for several times (for example, five times), a start-up preparation signal is output from the switch element 52 to a controller included in the first substrate module 34.

Subsequently, the user suctions in a state of biting the mouthpiece 23 or the tobacco capsule 12. Therefore, the air in the retention unit 22 is suctioned and the pressure inside the retention unit 22 becomes negative. When the pressure inside the retention unit 22 becomes negative, the air in the pressure change room 51 is suctioned through the inside of the atomization container 195 (inside the atomization room M) of the cartridge 11, the buffer space S3, and the communication port 51 such that it also becomes the negative pressure inside the pressure change room S1. More specifically, the air in the pressure change room S1 flows into the buffer space S3 through the communication port 51 and then flows into the heater holder 196 through the second air-suction hole 216. The air flowing into the heater holder 196 passes through the flow passage tube 197 through the ventilation passage 226 and the atomization container 195 and then enters the mouth of the user through the mouthpiece 23. The pressure sensor 53 outputs a start-up signal to the controller when the pressure sensor 53 detects that the pressure inside the pressure change room S1 is less than a predetermined value, for example.

The controller receiving the start-up signal causes the heater 194 of the cartridge 11 to be electrified. Since it becomes the negative pressure inside the retention unit 22, fresh air is introduced in the retention unit 22 through the ventilation hole 131. The fresh air is introduced into the atomization room M of the cartridge 11 (the opening room 203 of the tank 191) through the first air-suction hole 209 formed in the heater holder 196 of the cartridge 11 and the ventilation passage 226 of the atomization container 195.

The electrical heating wire 205 generates heat when the heater 194 is electrified. Therefore, the liquid aerosol source impregnating the wick 204 through the mesh body 193 is heated and atomized. The atomized aerosol fills the atomization room M. Then, the atomized aerosol together with the fresh air introduced into the atomization room M is suctioned to the mouthpiece 23 side through the flow passage tube 197 of the tank 191. Thereafter, a gaseous mixture of the atomized aerosol and air enters the mouth of the user through the tobacco capsule 12. Accordingly, the user may taste a flavor of the tobacco.

In the cartridge 11, the liquid aerosol source stored in the liquid storage room 202 of the tank 191 is absorbed by the mesh body 193 and further absorbed by the wick 204. When the mesh body 193 and the wick 204 is saturated (exceeding a liquid retention force), there is a risk that the liquid aerosol source leaks out to the heater holder 196 side from an interval between the external circumferential portion of the mesh body 193 and the internal circumferential surface of the circumferential wall 191*b* in the tank 191 and through the internal circumferential surface.

The liquid accumulation portion 223 is formed on the external circumferential surface of the atomization container 195 positioned at the heater holder 196 side of the mesh body 193. Accordingly, the liquid aerosol source is stored in the liquid accumulation portion 223 and leakage to the heater holder 196 side is prevented.

More specifically, according to the present embodiment, a volume (space volume) of the liquid accumulation portion 223 is approximately 53.4 cubic millimeters. In a case of assuming that a residual liquid quantity in the liquid storage room 202 of the tank 191 is ⅓ and a headspace volume expansion coefficient (a volume expansion coefficient of the air in the residual ⅔ space in the liquid storage room 202) is 6%, there is approximately 100 cubic millimeters of the liquid aerosol source being extruded from the liquid storage room 202 due to the air expansion in the liquid storage room 202 of the tank 191. Among the extruded liquid aerosol source, there is approximately 20-30 cubic millimeters of the liquid aerosol source may be retained by the mesh body 193 and the wick 204. Among the approximately 100 cubic millimeters of the liquid aerosol source, the remaining 70-80 cubic millimeters of the liquid aerosol source is accumulated in the accumulation portion 223.

The liquid accumulation portion 223 is formed that the gap between the external circumferential surface of the cylinder portion 217 and the circumferential wall 191*b* of the tank 191 gradually becomes narrower towards the tip end of the protrusion portion 219 from the seal portion 222. In other words, in the vicinity of the protrusion portion 219 of the cylinder portion 217, the narrow portion 279 where the gap between the protrusion portion 219 and the circumferential wall 191*b* of the tank 191 becomes narrow is formed. Accordingly, among the liquid aerosol source extruded from the liquid storage room 202 of the tank 191, it is easy for the residual aerosol source after the mesh body 193 and the wick 204 are saturated to be suctioned due to the narrow portion 279 and the residual aerosol source actively flows to the liquid accumulation portion 223 through the narrow portion 279.

In other words, the liquid aerosol source stored in the liquid storage room 202 of the tank 191 is firstly absorbed by the mesh body 193 and then absorbed by the wick 204. After the mesh body 193 and the wick 204 are saturated, the liquid aerosol source is suctioned by the narrow portion 279 and accumulated in the liquid accumulation portion 223.

On the other hand, when the saturation state of the mesh body 193 is resolved, the liquid aerosol source stored in the liquid accumulation portion 223 is suctioned through the narrow portion 279 (the interval between the protrusion portion 219 and the circumferential wall 191*b* of the tank 191). Then, the liquid aerosol source is absorbed by the mesh body 193. In other words, the liquid aerosol source stored in the liquid accumulation portion 223 flows back to the liquid storage room 202 of the tank 191 through the narrow portion 279. At this time, since the narrow portion 279 is covered (blocked) by the external circumferential portion of the mesh body 193, a capillary force due to the mesh body 193 also applies such that the liquid aerosol source efficiently flows back to the liquid storage room 202 of the tank 191.

Since two notch portions 222*a* are formed in the seal portion 222 of the cylinder portion 217, the liquid accumulation portion 223 and the external air are communicated through the notch portions 222*a* of the seal portion 222 and a gap between the engagement hole 198 of the tank 191 and the engagement piece 206 (engagement claw 207) of the heater holder 196. As another example, the liquid accumulation portion 223 and the external air may be communicated through the notch portions 222*a* of the seal portion 222 and the first air-suction hole 209 of the heater holder 196. Accordingly, it is impossible to generate a pressure difference between the inside and outside the liquid accumulation portion 223. As a result, an unintentional leakage of the liquid aerosol source to the outside from the liquid accumulation portion 223 is prevented and the liquid aerosol source efficiently flows back to the liquid storage room 202 of the tank 191.

In this manner, in the present embodiment, the main body unit 10 includes the power unit 21 (power source), the retention unit 22 (accommodation portion) having a cylindrical shape and configured to be capable of store the aerosol source, and the mouthpiece 23 in which the suction port 23*a* configured to suck the aerosol atomized by the aerosol source is formed. The main body unit 10 includes the connection portion 300 connecting the power unit 21, the retention unit 22, and the mouthpiece 23 in the axial direction in which the axis O (central axis) of the main body unit 10 extends. The connection portion 300 includes the first rotation connection portion 301 releasing the connection between the power unit 21 and the retention unit 22 by applying the first torque 301T around the axis O, and the second rotation connection portion 302 releasing the connection between the retention unit 22 and the mouth piece 23 by applying the second torque 302T smaller than the first torque 301T around the axis O.

According to the configuration, since the second torque 302T around the axis O required to release the connection between the retention unit 22 and the mouthpiece 23 in the second rotation connection portion 302 is smaller than the first torque 301T required to release the connection between the power unit 21 and the retention unit 22 in the first rotation connection portion 301, it is possible to prevent co-rotation of the retention unit 22 and the power unit 21 at the time of detaching the mouthpiece 23 from the retention unit 22.

In the present embodiment, the rotation directions M1 and M2 around the axis O for connection and releasing the connection of the first rotation connection portion 301 and the second rotation connection portion 302 are the same as each other.

According to the configuration, it is possible to provide a unified sense of the assembly operation to the user and it is possible to improve the convenience (usability) of the assembling.

In the present embodiment, the first rotation connector 301 connects the power unit 21 with the retention unit 22 (the other side) by inserting the horizontal engagement convex portion 102 (the engagement protruding portion) provided at the power unit 21 (one side) into an engagement groove 158 (the engagement groove portion) provided at the retention unit 22 and rotating around the axis O, and the second rotation connector 302 connects the retention unit 22 with the mouthpiece 23 by screwing the male screw portion 160*a* provided at the mouthpiece 23 (one side) with respect to the female screw portion 123*a* provided at the retention unit 22 (the other side) around the axis O.

According to the configuration, the connection structures of the first rotation connection portion 301 and the second rotation connection portion 302 are different with each other. Since there is almost no possibility that the magnitudes of the first torque 301T and the second torque 302T are same unless intentionally adjusting, the first torque 301T and the second torque 302T is easily different. Accordingly, the magnitude relationship between the first torque 301T and the second torque 302T are capable of being easily adjusted.

In the first rotation connection portion 301, the horizontal engagement convex portion 102 may be provided at the retention unit 22 and the engagement groove 158 may be provided at the power unit 21. In the second rotation connection portion 302, the male screw portion 160*a* may be provided at the retention unit 22 and the female screw portion 123*a* may be provided at the mouthpiece 23.

The suction device 1 according to the present embodiment includes the main body unit 10, the cartridge 11 configured to store the aerosol source and inserted into the retention unit 22 of the main body unit 10 so as to be relatively rotated around the axis O, and the first rotation restriction portion 330 restricting the relative rotation of the cartridge 11 with respect to the retention unit 22.

According to the configuration, since the cartridge 11 is positioned in the circumferential direction around the axis O, it is capable of preventing the cartridge 11 from rotating in a state the cartridge 11 is stored in the retention unit 22.

In the present embodiment, the first rotation restriction portion 330 is provided at the power unit 21 (one side) and has the vertical engagement convex portion 101 (first convex portion) extending toward the cartridge (the other side) in the axial direction, and the engagement concave portion 210 (the first concave portion) provided at the cartridge 11 and into which the vertical engagement convex portion 101 is inserted in the axial direction. The vertical engagement convex portion 101 and the engagement concave portion 210 are formed on the same radius with the axis O as a center.

According to the configuration, when the cartridge 11 and the power unit 21 are relatively rotated around the axis O, the vertical engagement convex portion 101 is inserted into engagement concave portion 210 which is disposed on the same radius. Thereby, a rotation restriction of the cartridge 11 is performed.

In the first rotation restriction portion 330, the vertical engagement convex portion 101 may be provided at the cartridge 11 and the engagement concave portion 210 may be provided at the power unit 21.

In the present embodiment, the mouthpiece 23 includes the first slip prevention member (cartridge contact portion) 161 configured to rotate the cartridge 11 around the axis O with respect to the power unit 21.

According to the configuration, when the mouthpiece 23 is rotated, the cartridge 11 rotates and the rotation restriction of the cartridge 11 is performed. Thereby, there is not necessity to rotate the cartridge directly by hands.

In the present embodiment, the mouthpiece 23 includes the mouthpiece main body 160 (the suction port main body) to which the first slip prevention member 161 is attached and connected with the retention unit 22 via the second rotation connection portion 302, and the first slip prevention member 161 is in contact with the cartridge 11 during a period when the mouthpiece main body 160 is connected to the retention unit 22.

According to the configuration, since the cartridge 11 rotates with the mouthpiece 23 when the mouthpiece 23 is attached to the retention unit 22, a connection between the mouthpiece 23 and the retention unit 22 and a rotation restriction of the cartridge 11 are capable of being simultaneously performed.

The present embodiment includes the second rotation restriction portion 350 restrict a relatively rotation of the first slip prevention member 161 with respect to the mouthpiece 23.

According to the configuration, idling operation (slip) of the first slip prevention member 161 with respect to the mouthpiece main body 160 may be prevented.

In the present embodiment, the second rotation restriction portion 350 includes the fitting protrusion 170 (the second convex portion) provided at the first slip prevention member 161 (one side) and extends toward the mouthpiece main body 160 (the other side) in the axial direction, and the penetration hole 168 (the second concave portion) provided in the mouthpiece main body 160 and into which the fitting protrusion 170 is capable of being inserted in the axial direction. The penetration hole 168 and the suction port 23*a* are integrally formed.

According to the configuration, idling operation (slip) of the first slip prevention member 161 with respect to the mouthpiece main body 160 is capable of be prevented by fitting the fitting protrusion 170 into the penetration hole 168 integrally formed with the suction port 23*a*. There is no necessity to form another fitting groove apart from the suction port 23*a*, the parts are easily manufactured.

In the second rotation restriction portion 350, the fitting protrusion 170 may be provided at the mouthpiece main body 160 and the penetration hole 168 may be provided in first slip prevention member 161.

In the present embodiment, the penetration hole 191*d* (the communication hole) communicating with the suction port 23*a* is formed on the bottom portion 191*c* (the contact surface) of the cartridge 11, and the bottom portion 191*c* contacts with the first slip prevention member 161. The first slip prevention member 161 is compressed between the mouthpiece main body 160 and the cartridge 11 and airtightly communicates the penetration hole 191*d* with the suction port 23*a* in a state that the mouthpiece main body 160 is connected with the retention unit 22 via the second rotation connection portion 302.

According to the configuration, the penetration hole 191*d* of the cartridge 11 and the suction port 23*a* of the mouthpiece main body 160 are airtigthly sealed by pressing and crushing the first slip prevention member 161 in the axial direction. Thereby, the aerosol generated in the cartridge 11 is capable of being sucked via the mouthpiece 23.

In the present embodiment, the first slip prevention member 161 is made from a silicone resin (elastic resin material).

According to the configuration, due to the elastic deformation of the first slip prevention member, it becomes easy to apply the friction force in the circumferential direction to cause the cartridge 11 to rotate and apply the pressing force in the axial direction to press and seal the cartridge 11. The first slip prevention member 161 becomes easy to be assembled with the mouthpiece main body 160. As shown in FIG. 12, the opening at the retention unit 22 side of the mouthpiece main body 160 has the reduced diameter than the ring portion 169 of the first slip prevention member 161, and if the ring portion 169 is elastically deformed and moved through the reduced-diameter portion, the ring portion 169 restores and fitted to the mouthpiece main body 160. Accordingly, slipping of the first slip prevention member 161 with respect to the mouthpiece main body 160 is prevented.

The first slip prevention member 161 may be formed from other elastic resin materials such as rubber, elastomer, or the like besides the silicone resin.

A configuration according to the present embodiment has the tobacco capsule 12 (flavor source container) attached to the mouthpiece 23.

According to this configuration, it is possible to add a flavor to the aerosol passing through the suction port 23*a*.

Other Modification Example

Preferred embodiments of the present invention have been described above, the present invention is not limited to the embodiments and modifications thereof. Additions, omissions, substitutions and other changes in the structure are possible without departing from the spirit of the present invention. The present invention is not limited by the foregoing description and is limited only by the scope of the appended claims.

For example, according to the above-described embodiment, an example of the suction device 1 configured for the tobacco capsule 12 to be attachable to and detachable from is described as an example of an aerosol generation device for generating aerosol without combustion is described; however, the aerosol generation device is not limited to the configuration only. As another example of the aerosol generation device, a configuration without the tobacco capsule 12 such as an electrical tobacco may be provided. In this case, the aerosol source including a flavor is accommodated in the cartridge 11 and the aerosol including the flavor is generated by the aerosol generation device.

In other words, in the above-described embodiment, a configuration having the main body unit 10 and the cartridge 11 while without the tobacco capsule 12 may be referred to as an aerosol generation device. A configuration having the main body unit 10 only while without the cartridge 11 and the tobacco capsule 12 may be referred to as a main body unit of an aerosol generation device.

According to the above-described embodiment, a case in which the main body unit 10 is a divided configuration of the power unit 21, the retention unit 22, and the mouthpiece 23 is described; however, the main body unit 10 is not limited to the configuration only. For example, the power unit 21 and the retention unit 22 may be integrally formed, and the retention unit 22 and the mouthpiece 23 may be integrally formed. At least one of the power unit 21, the retention unit 22, and the mouthpiece 23 may be further divided into a plurality of units.

According to the above-described embodiment, a configuration that the retention unit 22 is formed in a cylindrical shape to surround the circumference of the cartridge 11 is described; however, the retention unit 22 is not limited to the configuration only. The retention unit 22 only has to be a configuration capable of retaining the cartridge 11. In the present description, attachment and detachment of the cartridge 11 and the main body unit 10 (power unit 21) is not limited to the configuration of accommodating the cartridge 11 in the retention unit 22 and being retained by the mouthpiece 23, and the configuration of simply connecting or disconnecting the pin electrodes 49 with the connection electrodes 213*b*, 214*b* is included.

According to the above-described embodiment, a configuration that the power unit 21 and the retention unit 22 are formed in cylindrical shapes and disposed coaxially is described; however, the power unit 21 and the retention unit 22 are not limited only to this configuration. The power unit 21 and the retention unit 22 may be formed in different shapes.

According to the above-described embodiment, a configuration that the storage battery 33 and the substrate modules 34, 35 are carried on the storage battery holder 36 is described; however, the configuration is not limited thereto. The storage battery 33 and the substrate modules 34, 35 may be directed carried in the housing 31.

According to the above-described embodiment, a configuration of the button 78 (switch element 52) for outputting the start-up preparation signal is described; however, a configuration without the button 78 (a configuration for start-up by a detection by the pressure sensor 53) may be configured.

Part of the above-described embodiment or the whole embodiment may be disclosed in the following appendix and are not limited thereto.

According to the embodiment, since the second torque in the second rotation connection portion required for release the connection between the accommodation portion and the suction port part is smaller than the first torque required in the first rotation connection portion for release the connection between the power source unit and the accommodation portion, when the suction port part is detached from the accommodation portion, the power source is prevented from co-rotating with the accommodation portion.

According to the embodiment, it is possible to provide a unified sense of the assembly operation to the user and it is possible to improve the convenience (usability) of the assembling.

According to the embodiment, a connection structure of the first rotation connection portion is different from a connection structure of the second rotation connection portion. Since the connection structures are different from each other, there is almost no possibility that the magnitudes of the first torque and the second torque are same unless intentionally adjusting, the first torque and the second torque is easily different. Accordingly, the magnitude relationship between the first torque and the second torque are capable of being easily adjusted.

According to the embodiment, since the cartridge is positioned in the circumferential direction around the central axis, the cartridge is prevented from rotating in a state that the cartridge is accommodated in the accommodation portion.

According to the present aspect, since the first protrusion part is inserted into the first groove disposed on the same radius with the first protrusion part when the cartridge and the power source are relatively rotated around the central axis, a rotation of the cartridge is restricted.

According to the present aspect, since the cartridge rotates by rotating the suction port part, and the rotation of the cartridge is restricted, there is not necessity to rotate the cartridge directly by hands.

According to the present aspect, since the cartridge rotates with the suction port part when the suction port part is attached to the accommodation portion, a connection between the suction port part and the accommodation portion is simultaneously performed with the restriction of the rotation of the cartridge.

According to the present aspect, an idling operation (slip) of the cartridge contact portion with respect to the suction port main body is prevented.

According to the present aspect, the idling operation (slip) of the cartridge contact portion with respect to the suction port main body is prevented by fitting the second protrusion portion into the second groove integrally formed with the suction port part.

According to the present aspect, the cartridge contact portion is pressed and crushed in the axial direction, thereby the communication hole of the cartridge and the suction port of the suction port part is airtightly sealed with each other, and the aerosol generated in the cartridge is capable of being sucked through the suction port part.

According to the present aspect, due to the elastic deformation of the cartridge contact portion, the friction force for rotating the cartridge in the circumferential direction is easily applied and the pressing force in the axial direction to press and seal the cartridge is easily applied.

According to the present aspect, it is possible to add a flavor to the aerosol passing through the suction port.

(Appendix 1)

A main body unit of an aerosol generation device comprising a power source, an accommodation portion being capable of storing an aerosol source, and a suction port part where a suction port for suctioning aerosol by atomizing the aerosol source is formed, wherein the main body unit comprises a connection portion connecting the power source, the accommodation portion, and the suction port part in an axis direction in which a central axis of the main body unit are elongated, the connection portion connects the power source with the accommodation portion by inserting an engagement protruding portion into an engagement groove and rotating around the center axis, the engagement protruding portion is provided either of the power source or the accommodation portion, and the accommodation portion is connected with the suction port part by screwing a male screw portion with respect to a female screw portion around the central axis of the accommodation portion, the male screw portion is provided at either of the accommodation portion or the suction port part, the female screw portion is provided the other of the accommodation portion or the suction port part.

(Appendix 2)

A main body unit of an aerosol generation device comprising a first unit, a second unit, and a third unit, wherein the main body unit comprises a connector connecting the first unit, the second unit, and the third unit in an axial direction in which a central axis of the main body unit is elongated, and wherein the connector comprises: a first rotation connection portion releasing a connection between the first unit and the second unit by applying a first torque around the central axis; and a second rotation connection portion releasing a connection between the second unit and the third unit by applying a second torque around the central axis smaller than the first torque.

(Appendix 3)

A main body unit of an aerosol generation device comprising a first unit, a second unit, and a third unit, wherein the main body unit comprises a connector connecting the first unit, the second unit, and the third unit in an axial direction in which a central axis of the main body unit is elongated, and wherein the connector comprises: a first connection portion releasing a connection between the first unit and the second unit by applying a first load around the central axis; and a second rotation connection portion releasing a connection between the second unit and the third unit by applying a second load around the central axis smaller than the first load.

The first unit, the second unit, and the third unit in the second and third appendix may be any one of the power unit 21, the retention unit 22, and the mouthpiece 23, and may be a unit in which the power unit 21, the retention unit 22, and the mouthpiece 23 are divided to plurality of the unit.

The appendix 3 defines the first connection portion and the second connection portion include an axial fitting type as a super-ordinate conception of the first rotation connection portion and the second rotation connection portion. The first load and the second load in the appendix 3 include a pull out load in an axial disconnection. That is, the first unit, the second unit, and the third unit may be connected by a fitting type using a dimensional tolerance in the axial direction. These types can be obtained the effects same as the above described embodiments.

It is possible to replace the constituent elements in the above described embodiments to well-known constituents as appropriate without departing from the spirit of the present invention. Each of the above-described modification examples may be suitably combined.

What is claimed is:

1. An aerosol generation device comprising:

a power source;

an accommodation portion having a cylindrical shape and configured to store an aerosol source;

a suction port part formed with a suction port configured to suck an aerosol made from the aerosol source atomized;

a connector connecting the power source, the accommodation portion, and the suction port part in an axial direction extending a central axis of the main body unit is provided; and a cartridge configured to accommodate the aerosol source and inserted into the accommodation portion of the main body unit to be rotatable around the central axis; and a first rotation restriction portion configured to restrict a relative rotation of the cartridge with respect to the accommodation portion, wherein the connector comprises a first rotation connector configured to release a connection between the power source and the accommodation portion by applying a first torque around the central axis, and a second rotation connector configured to release a connection between the accommodation portion and the suction port part by applying a second torque smaller than the first torque around the central axis, and wherein the first rotation restriction portion comprises:

a first convex provided at either one of the cartridge or the power source and extend toward the other in the axial direction; and a first concave portion provided at the other of the cartridge or the power source and into which the first convex is insertable in the axial direction, wherein the first convex and the first concave portion are formed on a same radius with the central axis as a center.

2. The aerosol generation device according to claim 1, wherein rotation directions around the central axis of the first rotation connector and the second rotation connector for connecting and disconnecting the connections are same.

3. The aerosol generation device according to claim 1, wherein the first rotation connector connects the power source with the accommodation portion by inserting an engagement protruding portion into an engagement groove and rotating around the central axis, the engagement protruding portion is provided either of the power source or the accommodation portion, the engagement groove is provided at the other of the power source or the accommodation portion, and the second rotation connector connects the accommodation portion with the suction port part by screwing a male screw portion with respect to a female screw portion around the central axis of the accommodation portion, the male screw portion is provided at either of the accommodation portion or the suction port part, the female screw portion is provided at the other of the accommodation portion or the suction port part.

4. The aerosol generation device according to claim 1, wherein the suction port part comprises a cartridge contact portion making the cartridge to rotate with respect to the power source around the central axis.

5. The aerosol generation device according to claim 4, wherein the suction port part comprises a suction port main body in which the cartridge contact portion is attached, and connected to the accommodation portion via the second rotation connection portion, and the cartridge contact portion contacts with the cartridge on the way to connect the suction port main body to the accommodation portion.

6. The aerosol generation device according to claim 5, comprising a second rotation restriction portion configured to restrict a relative rotation of the cartridge contact portion with respect to the suction port main body.

7. The aerosol generation device according to claim 6, wherein the second rotation restriction portion comprises:

a second convex portion provided either the suction port main body or the cartridge contact portion and extend toward the other in the axial direction; and a second concave portion provided the other the suction port main body or the cartridge contact portion and into which the second convex portion is insertable in the axial direction, wherein the second concave portion and the suction port are integrally formed.

8. The aerosol generation device according to claim 4, wherein a communication hole communicating with the suction port is formed on a contact surface, to which the cartridge contact portion is contacted, of the cartridge.

9. The aerosol generation device according to claim 4, wherein the cartridge contact portion is made of elastic resin.

10. A non-combustion suction device, comprising:

the aerosol generation device according to claim 1, and a flavor source container attached to the suction port part of the aerosol generation device.

* * * * *